US012409489B2

(12) United States Patent
Kishigami

(10) Patent No.: US 12,409,489 B2
(45) Date of Patent: Sep. 9, 2025

(54) PRESS FORMING METHOD AND PRESS FORMING APPARATUS FOR OUTER PANEL OF AUTOMOBILE

(71) Applicant: JFE STEEL CORPORATION, Tokyo (JP)

(72) Inventor: Yasuhiro Kishigami, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 272 days.

(21) Appl. No.: 18/033,240

(22) PCT Filed: Jun. 9, 2021

(86) PCT No.: PCT/JP2021/021932

§ 371 (c)(1),
(2) Date: Apr. 21, 2023

(87) PCT Pub. No.: WO2022/091472

PCT Pub. Date: May 5, 2022

(65) Prior Publication Data

US 2023/0390820 A1 Dec. 7, 2023

(30) Foreign Application Priority Data

Oct. 26, 2020 (JP) ..... 2020-178824

(51) Int. Cl.
*B21D 53/88* (2006.01)
*B21D 22/26* (2006.01)
(Continued)

(52) U.S. Cl.
CPC ..... *B21D 53/88* (2013.01); *B21D 22/26* (2013.01); *B21D 24/04* (2013.01); *B21D 37/10* (2013.01)

(58) Field of Classification Search
CPC ..... B21D 22/10; B21D 22/20; B21D 22/26; B21D 24/00; B21D 24/04; B21D 37/10; B21D 53/88
See application file for complete search history.

(56) References Cited

U.S. PATENT DOCUMENTS 5,119,658 A * 6/1992 de Smet ..... B21D 22/10 72/348
2009/0038365 A1 2/2009 Yoshida et al.
(Continued)

FOREIGN PATENT DOCUMENTS

JP S63-058652 B2 11/1988
JP H11-277157 A 10/1999
(Continued)

OTHER PUBLICATIONS

Aug. 24, 2021 Search Report issued in International Patent Application No. PCT/JP2021/021932.
(Continued)

*Primary Examiner* — Teresa M Ekiert
(74) *Attorney, Agent, or Firm* — Oliff PLC

(57) ABSTRACT

A press forming method includes: moving a die toward a punch; bringing a punch side and a die side elastic bodies into contact with a metal sheet; and press forming the metal sheet, wherein an amount of protrusion of the punch side elastic body is set so that the punch side elastic body: comes into contact with the metal sheet before the punch; and becomes flush at a bottom dead center, and an amount of protrusion of the die side elastic body is set so that: the die side elastic body comes into contact with the metal sheet before the punch; and a product of: a load of the die side elastic body; and a friction coefficient between the die side elastic body and the metal sheet, becomes equal to or larger than an absolute value of a difference between tensions
(Continued)

acting on the portions sandwiching a character-line equivalent portion.

16 Claims, 8 Drawing Sheets

(51) Int. Cl.
*B21D 24/04* (2006.01)
*B21D 37/10* (2006.01)

(56) References Cited

U.S. PATENT DOCUMENTS

| | | | | |
|---|---|---|---|---|
| 2012/0137749 | A1 | 6/2012 | Park | |
| 2014/0356643 | A1* | 12/2014 | Nakata | B21D 22/26 428/603 |
| 2015/0298195 | A1 | 10/2015 | Jurich et al. | |
| 2017/0326612 | A1* | 11/2017 | Alpen | B21D 24/04 |
| 2018/0078986 | A1* | 3/2018 | Suzuki | B21D 22/26 |
| 2022/0388053 | A1 | 12/2022 | Kishigami | |

FOREIGN PATENT DOCUMENTS

| | | | |
|---|---|---|---|
| JP | 2014-28379 | A | 2/2014 |
| JP | 2015-199102 | A | 11/2015 |
| JP | 2015-224123 | A | 12/2015 |
| JP | 5876786 | B2 | 3/2016 |
| JP | 5959702 | B1 | 8/2016 |
| JP | 2018-103249 | A | 7/2018 |
| JP | 2018-158351 | A | 10/2018 |
| JP | 2018-183786 | A | 11/2018 |
| JP | 6753502 | B1 | 9/2020 |
| KR | 10-2011-0037164 | A | 4/2011 |
| WO | 2007/102538 | A1 | 9/2007 |

OTHER PUBLICATIONS

Aug. 24, 2021 Written Opinion of the International Searching Authority issued in International Patent Application No. PCT/JP2021/021932.

Apr. 5, 2025 Office Action issued in Chinese Patent Application No. 202180071940.8.

* cited by examiner

PRESS FORMING METHOD AND PRESS FORMING APPARATUS FOR OUTER PANEL OF AUTOMOBILE

FIELD

The present invention relates to press forming methods and press forming apparatuses for outer panels of automobiles, the press forming methods and press forming apparatuses being for press forming metal sheets into outer panels of automobiles, the outer panels having character-lines formed therein. With respect to the present invention, a metal sheet refers to a sheet formed of any of various metals, such as stainless steel, aluminum, and magnesium, for example, a hot-rolled steel sheet, a cold-rolled steel sheet, or a surface-treated steel sheet, which is a steel sheet that has been subjected to surface treatment (such as electrogalvanization, hot-dip galvanizing, or organic coating treatment).

BACKGROUND

Outer panels of automobiles, the outer panels being used for, for example, door outers, front fenders, or rear fenders, of automobiles, often have character-lines formed on outer surfaces thereof, in terms of improving designability and tensile rigidity of the automobiles. These character-lines are normally formed by pressing a metal sheet (blank) against a ridgeline provided on a punch of press-forming dies and holding the metal sheet between the ridgeline and a valley-line of a die. In particular, in recent years, to further improve designability of automobiles, there is a demand for formation of character-lines that are sharp (that is, large in curvature (small in curvature radius) of ridgelines).

In this type of press forming, a linear pattern may be generated by contact between a ridgeline of a punch and a portion other than a portion where a character-line is supposed to be formed. This linear pattern will still remain after coating and will become an appearance defect called a skid line defect in the outer panel. Such skid line defects act as a constraint on improvement in designability of automobiles because a skid line defect becomes particularly noticeable in a case where press forming is performed by use of a punch having a ridgeline with a distal end formed of a small circular arc having a small radius of section in an attempt to form a sharp character-line.

Some techniques for forming character-lines by minimizing generation of such linear patterns have been proposed thus far.

For example, in a method disclosed in Patent Literature 1, a forming auxiliary cross-sectional shape of a design recess portion is provided in a die and a blank holder, the periphery of a blank is held therebetween, a central portion of the blank is thereby caused to undergo bending deformation beforehand along a forming surface of a punch, and thereafter the blank is subjected to forming by use of a punch and a design surface is formed thereon. In a method disclosed in Patent Literature 2, a suction port is formed on a press surface where a linear convex portion for forming a character-line is provided, press forming is performed by adhesion of a metal sheet to the press surface by use of a suction device that implements suction via a gas flow path from the suction port, and movement of the metal sheet is thereby minimized and skid lines are prevented. In a technique disclosed in Patent Literature 3, a steel sheet is subjected to primary forming by means of a punch angle and a cushion pad, deep drawing and stretch forming are thereafter performed while the punch is lowered, and formation of a skid line in a portion of a metal sheet is thereby prevented, the portion being where the punch angle has come into contact with.

In a technique disclosed in Patent Literature 4, in manufacturing a press formed part having a ridgeline, skid lines are prevented and a high quality press formed part is obtained, through a first press forming process of forming a preforming shape and a second press forming process of further forming the preforming shape. In a technique disclosed in Patent Literature 5, an elastic body is provided at a distal end portion of a punch, bending tendency due to initial contact by the punch is minimized, shifting of any generated bending tendency from a character-line is also minimized, and skid lines upon forming of the character-line are thereby minimized. In a technique disclosed in Patent Literature 6, a character-line is formed in a blank by means of a die pad formed of an elastic body and a distal end portion of a punch, and a portion other than the character-line is formed by means of a die and a punch, with the formed character-line still being restricted by the die pad and the punch. In a technique disclosed in Patent Literature 7, a plate-shaped workpiece is pressed against a lower die having a convex R portion for forming a character-line, the workpiece is brought into contact with a press pad, at a position near the convex R portion after the workpiece has held the convex R portion, and skidding of the workpiece is thereby minimized.

CITATION LIST

Patent Literature

Patent Literature 1: Japanese Patent No. 5876786

Patent Literature 2: Japanese Unexamined Patent Application, Publication No. 2015-199102

Patent Literature 3: Japanese Examined Patent Publication No. S63-058652

Patent Literature 4: Japanese Patent No. 5959702

Patent Literature 5: Japanese Unexamined Patent Application, Publication No. 2018-103249

Patent Literature 6: Japanese Unexamined Patent Application, Publication No. 2018-158351

Patent Literature 7: Japanese Unexamined Patent Application, Publication No. 2018-183786

SUMMARY

Technical Problem

However, the techniques disclosed in Patent Literature 1 to Patent Literature 7 have the following problems.

In the technique disclosed in Patent Literature 1, deformation by the die and the blank holder provided with the forming auxiliary cross-sectional shape is not restricted by the punch, only both end portions of the blank corresponding to the design recess portion are able to be restricted, and the bending deformation is thus limited to straight-lined shapes. The technique disclosed in Patent Literature 2 has problems in that the suction device not used in normal press forming is needed and the shape of the suction port is transferred onto a surface of the formed part. The technique disclosed in Patent Literature 3 has problems in that the final product shape is partially formed in the process of forming, and surface deflection occurs at the boundary of the forming incomplete portion.

The technique disclose in Patent Literature 4 has problems in that the die for forming the preforming shape is different from the die for forming the targeted shape, and the number of processes including the process of switching the dies is increased. The technique disclosed in Patent Literature 5 has problems in that a shape just like the shape of the ridgeline is unable to be formed because the convex side of the ridgeline is formed by the elastic body. The technique disclosed in Patent Literature 6 has problems in that in a case where plural character-lines are near each other, the character-lines are unable to be formed just like the targeted shape, because the character-lines are formed by means of a die pad formed of an elastic body. The technique disclosed in Patent Literature 7 has problems in that in a case where the form of a surface is complex, the appropriate time to bring a press pad into contact with a workpiece is unable to be set and a defective is generated on the workpiece by the press pad.

The present invention has been made in view of the above described problems and an object of the present invention is to provide a press forming method and a press forming apparatus that are for outer panels of automobiles, the press forming method and press forming apparatus enabling: prevention of skid lines without increase in man-hours for press forming; and formation of character-lines targeted.

Solution to Problem

To solve the problem and achieve the object, a press forming method for an outer panel of an automobile according to the present invention is the press forming method for press forming a metal sheet into the outer panel of the automobile, the outer panel having a character-line and a panel surface portion that is continuous on both sides of the character-line, by using a punch, a die facing the punch, and a blank holder facing end portions of the die, wherein the punch includes: a ridgeline to form the character-line; a punch side forming surface portion to form the panel surface portion; and a punch side elastic body supported to protrude toward the die than the punch side forming surface portion so that the punch side elastic body is able to come into contact with the metal sheet, along a character-line equivalent portion corresponding to the character-line in the metal sheet, at a position away from the character-line equivalent portion, on a side larger in tension in the press forming among portions on both sides sandwiching the character-line equivalent portion, and the die includes: a valley-line to form the character-line in cooperation with the ridgeline; a die side forming surface portion to form the panel surface portion; and a die-side elastic body supported to protrude toward the punch than the die side forming surface portion so that the die side elastic body comes into contact with and press the metal sheet, along the character-line equivalent portion, at a position away from the character-line equivalent portion, on a side smaller in tension in the press forming among portions on both sides sandwiching the character-line equivalent portion, the press forming method comprising: an elastic body contact step of relatively moving the die toward the punch in a state where both end portions of the metal sheet are sandwiched between the die and the blank holder, and bringing each of the punch side elastic body and the die side elastic body into contact with the metal sheet; and a press forming step of press forming the metal sheet into the outer panel of the automobile, the outer panel having the character-line formed by means of the ridgeline and the valley-line, by relatively moving the die toward the punch up to a bottom dead center with the punch side elastic body and the die side elastic body both being in contact with the metal sheet, wherein an amount of protrusion of the punch side elastic body from the punch side forming surface portion is set so that the punch side elastic body: comes into contact with the metal sheet before the ridgeline of the punch contacts the metal sheet at the elastic body contact step; and becomes flush with the punch side forming surface portion at the bottom dead center, and an amount of protrusion of the die side elastic body from the die side forming surface portion is set so that: the die side elastic body comes into contact with the metal sheet before the ridgeline of the punch contacts the metal sheet and the metal sheet is plastically deformed at the elastic body contact step; and a friction force given by a product of: a load of the die side elastic body pressing the metal sheet at the press forming step; and a friction coefficient between the die side elastic body and the metal sheet, becomes equal to or larger than an absolute value of a difference between tensions acting on the portions on both sides sandwiching the character-line equivalent portion.

Moreover, a press forming method for an outer panel of an automobile according to the present invention is the press forming method for press forming a metal sheet into the outer panel of the automobile, the outer panel having a character-line and a panel surface portion that is continuous on both sides of the character-line, by using a punch, a die facing the punch, and a blank holder facing end portions of the die, wherein the punch includes: a ridgeline to form the character-line; a punch side forming surface portion to form the panel surface portion; and a punch side elastic body supported to protrude toward the die than the punch side forming surface portion so that the punch side elastic body is able to come into contact with the metal sheet, along a character-line equivalent portion corresponding to the character-line in the metal sheet, at a position away from the character-line equivalent portion, on a side smaller in tension in the press forming among portions on both sides sandwiching the character-line equivalent portion, and the die includes: a valley-line to form the character-line in cooperation with the ridgeline; a die side forming surface portion to form the panel surface portion; and a die-side elastic body supported to protrude toward the punch than the die side forming surface portion so that the die side elastic body comes into contact with and press the metal sheet, along the character-line equivalent portion, at a position away from the character-line equivalent portion, on a side larger in tension in the press forming among portions on both sides sandwiching the character-line equivalent portion, the press forming method comprising: an elastic body contact step of relatively moving the die toward the punch in a state where both end portions of the metal sheet are being sandwiched between the die and the blank holder, and bringing each of the punch side elastic body and the die side elastic body into contact with the metal sheet; and a press forming step of press forming the metal sheet into the outer panel of the automobile, the outer panel having the character-line formed by means of the ridgeline and the valley-line, by relatively moving the die toward the punch up to a bottom dead center with the punch side elastic body and the die side elastic body both being in contact with the metal sheet, wherein an amount of protrusion of the punch side elastic body from the punch side forming surface portion is set so that the punch side elastic body: comes into contact with the metal sheet before the ridgeline of the punch contacts the metal sheet; and becomes flush with the punch side forming surface portion at the bottom dead center, and an amount of protrusion of the die side elastic body from the die side forming surface portion is set so that: the die side elastic body comes into contact with the metal sheet before the ridgeline of the punch contacts the metal sheet and the metal sheet is plastically deformed at the elastic body contact step; and a friction force given by a product of: a load of the die side elastic body pressing the metal sheet at the press forming step; and a friction coefficient between the die side elastic body and the metal sheet, becomes equal to or larger than an absolute value of a difference between tensions acting on the portions on both sides sandwiching the character-line equivalent portion.

Moreover, in the press forming method for the outer panel of the automobile according to the present invention, the punch side elastic body is movable along a press forming direction and is provided in the punch via a punch side movable body that supports the punch side elastic body by pressuring the punch side elastic body toward the die.

Moreover, in the press forming method for the outer panel of the automobile according to the present invention, the die side elastic body is movable along a press forming direction and is provided in the die via a die side movable body that supports the die side elastic body by pressuring the die side elastic body toward the punch.

Moreover, a press forming apparatus for an outer panel of an automobile according to the present invention is the press forming apparatus for press forming a metal sheet into the outer panel of the automobile, the outer panel having a character-line and a panel surface portion that is continuous on both sides of the character-line. The press forming apparatus includes: a punch; a die facing the punch; and a blank holder facing end portions of the die, wherein the punch includes: a ridgeline to form the character-line; a punch side forming surface portion to form the panel surface portion; and a punch side elastic body supported to protrude toward the die than the punch side forming surface portion so that the punch side elastic body is able to come into contact with the metal sheet, along a character-line equivalent portion corresponding to the character-line in the metal sheet, at a position away from the character-line equivalent portion, on a side larger in tension in the press forming among portions on both sides sandwiching the character-line equivalent portion, and the die includes: a valley-line to form the character-line in cooperation with the ridgeline; a die side forming surface portion to form the panel surface portion; and a die-side elastic body supported to protrude toward the punch than the die side forming surface portion so that the die side elastic body comes into contact with and press the metal sheet, along the character-line equivalent portion, at a position away from the character-line equivalent portion, on a side smaller in tension in the press forming among portions on both sides sandwiching the character-line equivalent portion, wherein an amount of protrusion of the punch side elastic body from the punch side forming surface portion is set so that the punch side elastic body: comes into contact with the metal sheet before the ridgeline of the punch contacts the metal sheet when the die is relatively moved toward the punch; and becomes flush with the punch side forming surface portion at a bottom dead center, and an amount of protrusion of the die side elastic body from the die side forming surface portion is set so that: the die side elastic body comes into contact with the metal sheet before the ridgeline of the punch contacts the metal sheet and the metal sheet is plastically deformed when the die is relatively moved toward the punch; and a friction force being given by a product of: a load of the die side elastic body pressing the metal sheet; and a friction coefficient between the die side elastic body and the metal sheet, becomes equal to or larger than an absolute value of a difference between tensions acting on the portions on both sides sandwiching the character-line equivalent portion.

Moreover, a press forming apparatus for an outer panel of an automobile according to the present invention is the press forming apparatus for press forming a metal sheet into the outer panel of the automobile, the outer panel having a character-line and panel surface portion that is continuous on both sides of the character-line. The press forming apparatus includes: a punch; a die facing the punch; and a blank holder facing end portions of the die, wherein the punch includes: a ridgeline to form the character-line; a punch side forming surface portion to form the panel surface portion; and a punch side elastic body supported to protrude toward the die than the punch side forming surface portion so that the punch side elastic body is able to come into contact with the metal sheet, along a character-line equivalent portion corresponding to the character-line in the metal sheet, at a position away from the character-line equivalent portion, on a side smaller in tension in the press forming among portions on both sides sandwiching the character-line equivalent portion, and the die includes: a valley-line to form the character-line in cooperation with the ridgeline; a die side forming surface portion to form the panel surface portion; and a die-side elastic body supported to protrude toward the punch than the die side forming surface portion so that the die side elastic body comes into contact with and press the metal sheet, along the character-line equivalent portion, at a position away from the character-line equivalent portion, on a side larger in tension in the press forming among portions on both sides sandwiching the character-line equivalent portion, wherein an amount of protrusion of the punch side elastic body from the punch side forming surface portion is set so that the punch side elastic body: comes into contact with the metal sheet before the ridgeline of the punch contacts the metal sheet when the die is relatively moved toward the punch; and becomes flush with the punch side forming surface portion at a bottom dead center, and an amount of protrusion of the die side elastic body from the die side forming surface portion is set so that: the die side elastic body comes into contact with the metal sheet before the ridgeline of the punch contacts the metal sheet and the metal sheet is plastically deformed when the die is relatively moved toward the punch; and a friction force being given by a product of: a load of the die side elastic body pressing the metal sheet; and a friction coefficient between the die side elastic body and the metal sheet, becomes equal to or larger than an absolute value of a difference between tensions acting on the portions on both sides sandwiching the character-line equivalent portion.

Moreover, in the press forming apparatus for the outer panel of the automobile according to the present invention, the punch side elastic body is movable along a press forming direction and is provided in the punch via a punch side movable body that supports the punch side elastic body by pressuring the punch side elastic body toward the die.

Moreover, in the press forming apparatus for the outer panel of the automobile according to the present invention, the die side elastic body is movable along a press forming direction and is provided in the die via a die side movable body that supports the die side elastic body by pressuring the die side elastic body toward the punch.

Advantageous Effects of Invention

The present invention enables: prevention of generation of a bending defective in a metal sheet due to a ridgeline of a punch, by bringing a punch side elastic body caused to protrude from a punch side forming surface portion, into contact with the metal sheet, to support the metal sheet, at a position away from a character-line equivalent portion, in the process of press forming the metal sheet into an outer panel of an automobile by use of the punch having the ridgeline, a die facing the punch and having a valley-line, and a blank holder facing end portions of the die, the outer panel having a character-line and a panel surface portion continuous on both sides of the character-line, the character-line being formed by the ridgeline and the valley-line; prevention of skidding of the metal sheet due to a difference in tension acting on both sides of the character-line equivalent portion of the metal sheet, by bringing a die side elastic body caused to protrude from a die side forming surface portion, into contact with the metal sheet, to press the metal sheet, at a position opposite to the punch side elastic body and away from the character-line equivalent portion, and thereby making a friction force larger than the difference in tension, the friction force being between the metal sheet and the die side elastic body caused to protrude from the die side forming surface portion and to be compressed; and thus obtainment of the outer panel of the automobile by press forming, the outer panel having the character-line formed therein, with skid lines being reduced.

DESCRIPTION OF EMBODIMENTS

A skid line generated in press forming for an outer panel of an automobile, the outer panel having a character-line, will be described, before description of press forming methods and press forming apparatuses for outer panels of automobiles, according to a first embodiment and a second embodiment of the present invention.

Why Skid Lines are Generated

Figure 9:
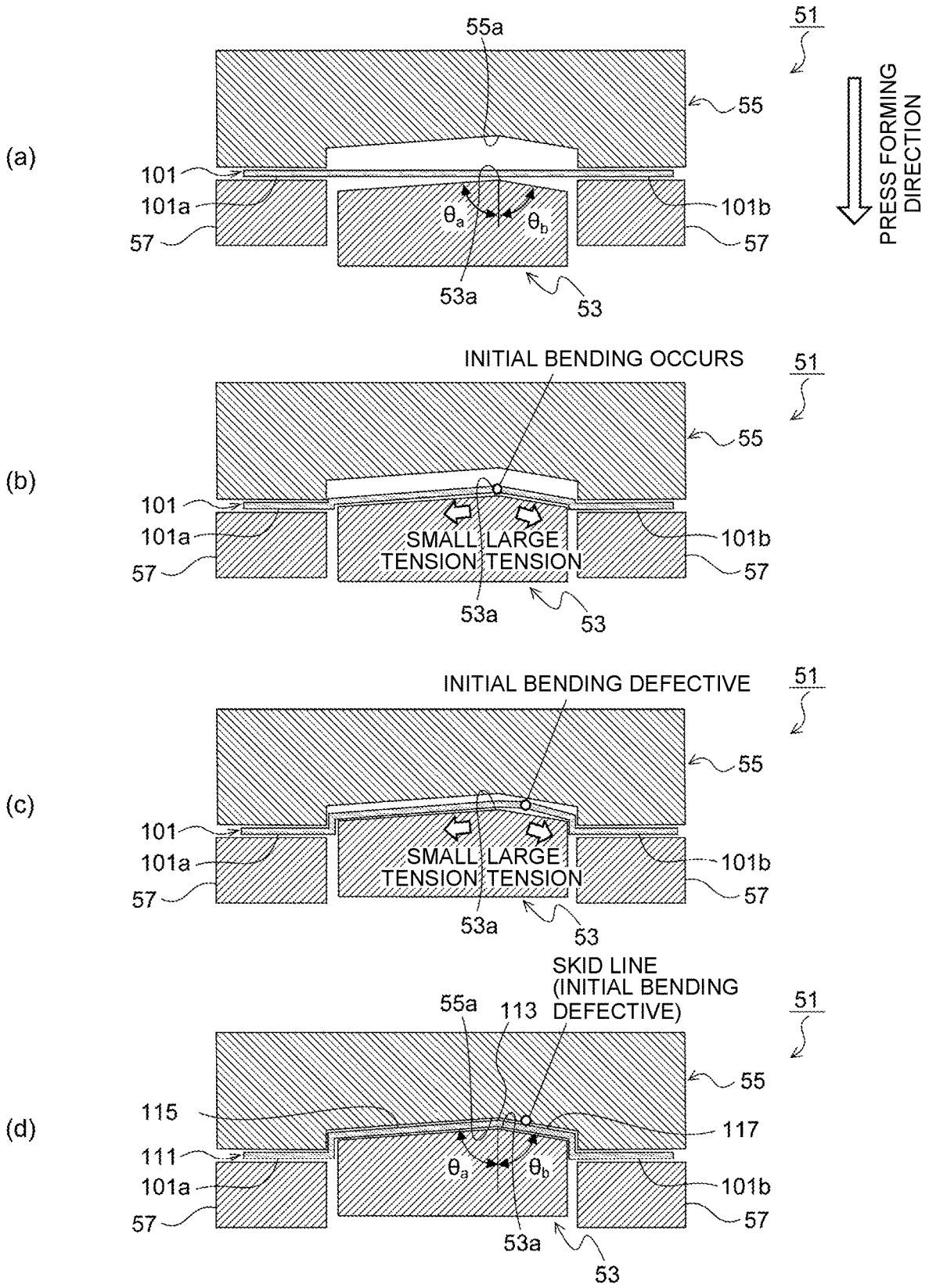
FIG. 9 is a diagram illustrating operation in a conventional press forming method and of a conventional press forming apparatus, for outer panels of automobiles, and a skid line generated in the process of press forming.

An outer panel 111 of an automobile, the outer panel 111 being targeted in the present invention, has, for example, as illustrated in FIG. 9(*d*), a character-line 113 and a panel surface portion 115 and a panel surface portion 117 that are continuous on both sides of the character-line 113, and is obtained by deep drawing as follows by use of a press forming apparatus 51 including a punch 53 having a ridgeline 53*a* extending in a direction perpendicular to the plane of paper of FIG. 9(*d*), a die 55 having a valley-line 55*a* extending in the direction perpendicular to the plane of paper, and a blank holder 57 facing to both of end portions of the die 55.

First, as illustrated in FIG. 9(*a*), each of an end portion 101*a* and an end portion 101*b* of a metal sheet 101 is sandwiched between the die 55 and the blank holder 57. With the metal sheet 101 still being sandwiched therebetween, as illustrated in FIG. 9(*a*) to FIG. 9(*d*), the die 55 and the blank holder 57 are relatively moved toward the punch 53 up to a bottom dead center and the outer panel 111 of an automobile is obtained by press forming, the outer panel 111 having the character-line 113 formed therein by means of the ridgeline 53*a* of the punch 53 and the valley-line 55*a* of the die 55.

In the process of this press forming, the relative movement of the die 55 toward the punch 53 first causes the ridgeline 53*a* of the punch 53 to come into contact with the metal sheet 101 and causes initial bending in the metal sheet 101 (FIG. 9(*b*)). In the process of deep drawing by means of the die 55 and the punch 53, tension is generated in the metal sheet 101 (FIG. 9(*b*) and FIG. 9(*c*)) in directions toward the end portion 101*a* and the end portion 101*b* from the initial bending defective therebetween.

Magnitudes of the tension generated on both sides of the initial bending defective in the metal sheet 101 differ from each other depending on: distances from the initial bending defective to the end portion 101*a* and the end portion 101*b* and angles of the panel surface portion 115 and the panel surface portion 117 (FIG. 9 (*d*)) to a press forming direction; or a difference between, for example, forming depths from the ridgeline 53*a* to the end portion 101*a* and the end portion 101*b*, the forming direction depths depending on those distances and angles.

For example, in a case where an acute angle of the panel surface portion 115 with reference to a line drawn in the press forming direction from the ridgeline 53*a* of the punch 53 is $\theta_a$, an acute angle of the panel surface portion 117 to the line is $\theta_b$, and the angle $\theta_b$ of the panel surface portion 117 is smaller than the angle $\theta_a$ of the panel surface portion 115 (see FIG. 9(*d*)), the tension generated toward the end portion 101*b* (a portion 107) of the metal sheet 101 becomes larger than the tension generated toward the end portion 101*a* (a portion 105) of the metal sheet 101 in the process of press forming (FIG. 9(*b*) and FIG. 9(*c*)).

In response to generation of a difference in tension between these portions on both sides of the initial bending defective, skidding toward the portion larger in tension is caused in the metal sheet 101 and the initial bending defective is displaced toward the end portion 101*b* larger in tension (FIG. 9(*c*)). The initial bending defective is then squashed by the punch 53 and the die 55 at the bottom dead center and a linear pattern, that is, a skid line, is generated (FIG. 9(*d*)).

As described above, a skid line in the outer panel 111 of an automobile, the outer panel 111 having the character-line 113 formed therein, is caused by imbalanced tension generated in the metal sheet 101 in the process of deep drawing. Examples of causes of imbalanced tension include, as described already, a difference between forming depths of the end portion 101*a* and the end portion 101*b* of the metal sheet 101, the difference being due to differences between distances and angles from the portion with which the ridgeline 53*a* of the punch 53 comes into contact to the end portion 101*a* and the end portion 101*b* of the metal sheet 101.

That is, in a case where the end portion 101*a* and the end portion 101*b* of the metal sheet 101 have different forming depths, tension generated toward the end portion 101*b* larger in forming depth becomes larger, and due to the tension difference from that toward the end portion 101*a* smaller in forming depth, the metal sheet 101 skids toward the end portion 101*b* and a skid line is generated.

The press forming methods and the press forming apparatuses for outer panels of automobiles, according to the first embodiment and the second embodiment of the present invention will be described next. The same reference sign will be assigned to components having the same or corresponding functions and redundant description thereof will be avoided, in the description hereinafter.

First Embodiment

Press Forming Apparatus

Figure 1:
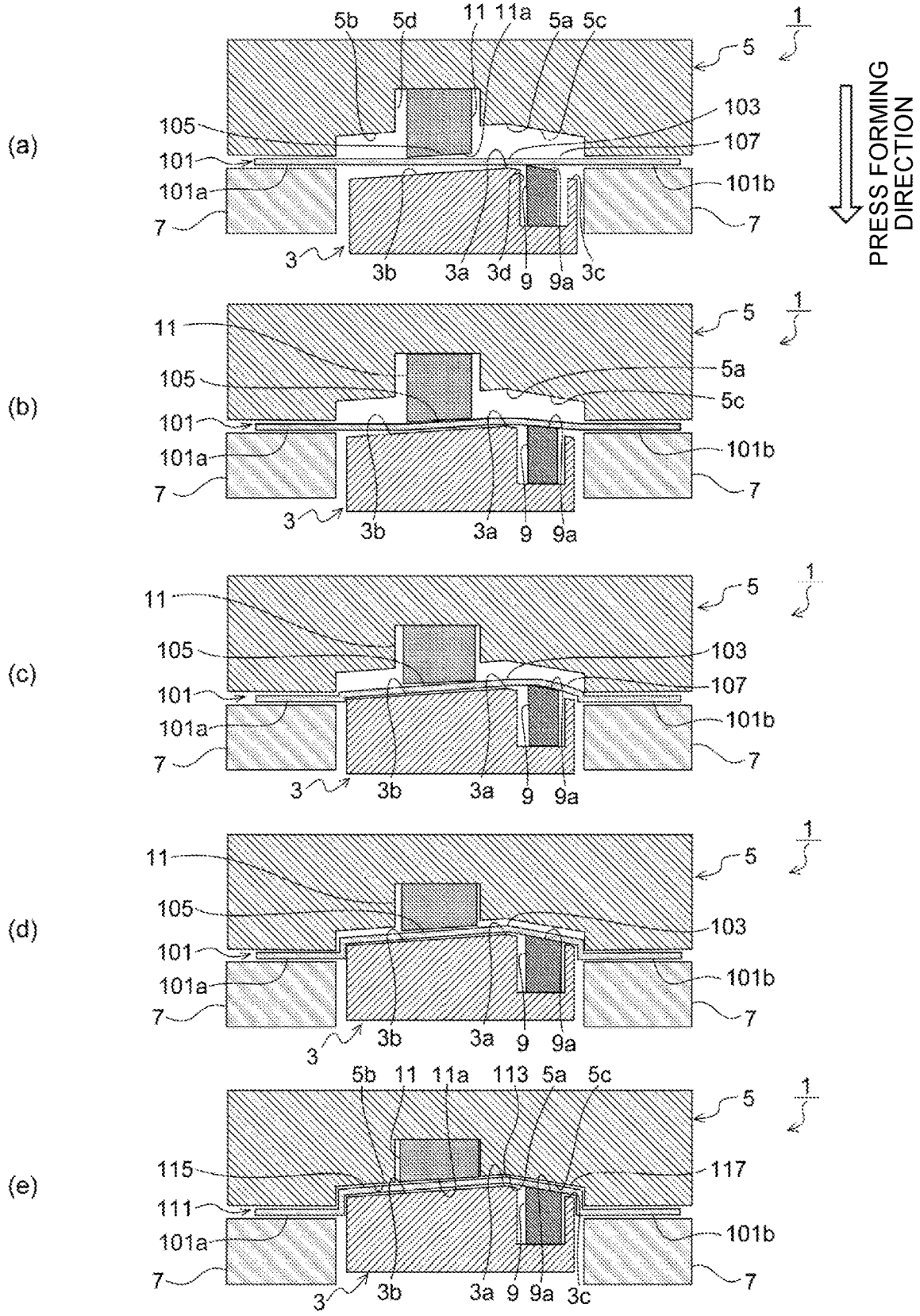
FIG. 1 is a diagram illustrating a press forming method and a configuration of a press forming apparatus, for outer panels of automobiles, according to a first embodiment of the present invention.

For example, as illustrated in FIG. 1, a press forming apparatus 1 for outer panels of automobiles (hereinafter, simply referred to as the "press forming apparatus 1"), according to the first embodiment is for press forming a metal sheet 101 into an outer panel of an automobile, the outer panel having a character-line 113 and a panel surface portion 115 and a panel surface portion 117 that are continuous on both sides of the character-line 113, and the press forming apparatus 1 includes a punch 3, a die 5, a blank holder 7, a punch side elastic body 9, and a die side elastic body 11.

FIG. 1(*a*) is a state before forming is started, FIG. 1(*b*) is a state where the punch side elastic body 9 and the die side elastic body 11 are in contact with the metal sheet 101, FIG. 1(*c*) is a state where the metal sheet 101 is being supported by the punch side elastic body 9, FIG. 1(*d*) is a state where the metal sheet 101 is being pressed by the die side elastic body 11, and FIG. 1(*e*) is a state at a bottom dead center.

Figure 2:
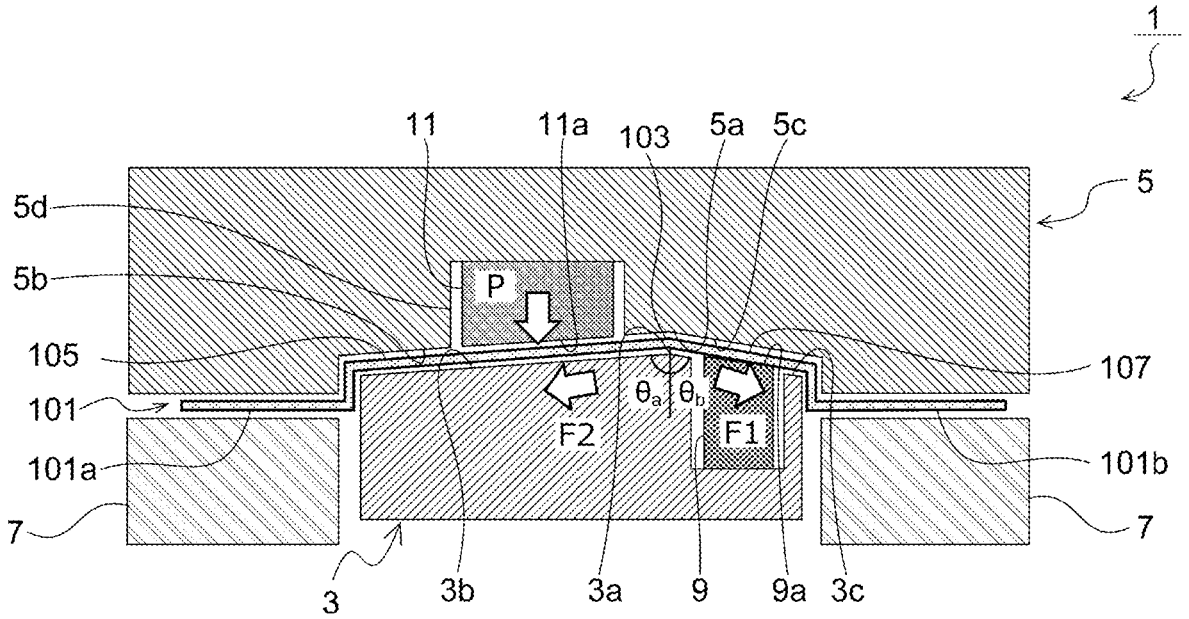
FIG. 2 is a diagram illustrating a load P to press a metal sheet by means of a die side elastic body that has been compressed and tension $F_1$ and tension $F_2$ generated in the metal sheet, in the process of press forming by the press forming method and press forming apparatus for outer panels of automobiles, according to the first embodiment of the present invention.

Furthermore, for an outer panel 111 of an automobile (FIG. 1(*e*)), the outer panel 111 being a target to be formed in this first embodiment, as illustrated in FIG. 9 described already, it is assumed that tension generated toward an end portion 101*b* from a boundary that is a character-line equivalent portion 103 in the metal sheet 101 is larger than tension generated toward an end portion 101*a* from the boundary, in the process of press forming (see FIG. 2).

Punch

The punch 3 has, as illustrated in FIG. 1: a ridgeline 3*a*; a punch side forming surface portion 3*b* and a punch side forming surface portion 3*c* that are positioned on both sides of the ridgeline 3*a* with the ridgeline 3*a* interposed therebetween; and a groove 3*d*.

The ridgeline 3*a* is to form the character-line 113 (FIG. 1(*e*)).

The punch side forming surface portion 3*b* and the punch side forming surface portion 3*c* are to respectively form the panel surface portion 115 and the panel surface portion 117 (FIG. 1(*e*)). The punch side forming surface portion 3*b* is to form a portion 105 smaller in tension acting on the metal sheet 101, into the panel surface portion 115 (FIG. 1(*e*)) in the process of press forming. The punch side forming surface portion 3*c*, on the other hand, is to form a portion 107 larger in tension acting on the metal sheet 101, into the panel surface portion 117 (FIG. 1(*e*)) in the process of press forming.

The groove 3*d* has been formed to be concave in the punch side forming surface portion 3*c* and has the punch side elastic body 9 provided therein.

Die

The die 5 has, as illustrated in FIG. 1: a valley-line 5*a*; a die side forming surface portion 5*b* and a die side forming surface portion 5*c* that are continuous on both sides of the valley-line 5*a* with the valley-line 5*a* interposed therebetween; and a groove 5*d*.

The valley-line 5*a* is to form the character-line 113, in cooperation with the ridgeline 3*a* of the punch 3.

The die side forming surface portion 5*b* is to form, in cooperation with the punch side forming surface portion 3*b*, the panel surface portion 115, and the die side forming surface portion 5*c* is to form, in cooperation with the punch side forming surface portion 3*c*, the panel surface portion 117.

The die side forming surface portion 5*b* is to form the portion 105 smaller in tension acting on the metal sheet 101, into the panel surface portion 115, in the process of press forming. The die side forming surface portion 5*c*, on the other hand, is to form the portion 107 larger in tension acting on the metal sheet 101, into the panel surface portion 117, in the process of press forming.

The groove 5*d* has been formed to be concave in the die side forming surface portion 5*b* and has the die side elastic body 11 provided therein.

Blank Holder

As illustrated in FIG. 1, the blank holder 7 is arranged to be facing both end portions of the die 5, and sandwiches, in cooperation with the die 5, the end portion 101*a* and the end portion 101*b* of the metal sheet 101 therebetween.

Punch Side Elastic Body

As illustrated in FIG. 1, the punch side elastic body 9 has a punch side contact surface portion 9*a* that comes into contact with the metal sheet 101, and the punch side contact surface portion 9*a* is provided in the groove 3*d* so that the punch side elastic body 9 protrudes: toward the die 5 than the punch side forming surface portion 3*c*; and thus is able to come into contact with the metal sheet 101, along the character-line equivalent portion 103 corresponding to the character-line 113 in the metal sheet, on the portion 107 on a side larger in tension in the process of press forming among the portion 105 and the portion 107 on both sides sandwiching the character-line equivalent portion 103, at a position away from the character-line equivalent portion 103.

The punch side elastic body 9 protrudes from the punch side forming surface portion 3*c* by an amount that has been set so that in relative movement of the die 5 toward the punch 3, the punch side contact surface portion 9*a* of the punch side elastic body 9 comes into contact with the metal sheet 101 before the ridgeline 3*a* of the punch 3 contacts the metal sheet 101.

The punch side elastic body 9 preferably has hardness and a shape that: moderate the bending shape of the metal sheet 101, the bending shape being made by the ridgeline 3*a*, in a state where the punch side elastic body 9 protrudes from the punch side forming surface portion 3*c* and is in contact with the metal sheet 101 to support the metal sheet 101, until the bottom dead center is reached; and enable the punch side elastic body 9 to be deformed along the shape of the press-forming die (the shape of the punch side forming surface portion 3*c*) at the bottom dead center (FIG. 1(*e*)), that is, to be deformed (to contract in a press forming direction) until the punch side contact surface portion 9*a* becomes flush with the punch side forming surface portion 3*c*. A specific material for this punch side elastic body 9 may be, for example, a rubber material or urethane material, having Shore hardness of 40 to 100 HS.

Die Side Elastic Body

The die side elastic body 11: is provided to protrude toward the punch 3 than the die side forming surface portion 5*b* so that the die side elastic body 11 comes into contact with and press the metal sheet 101 on the portion 105, along the character-line equivalent portion 103, at a position away from the character-line equivalent portion 103, the portion 105 being on a side smaller in tension in the process of press forming among the portion 105 and the portion 107 on both sides of the character-line equivalent portion 103 of the metal sheet 101; and has a die side contact surface portion 11*a* that comes into contact with the metal sheet 101.

The die side elastic body 11 protrudes from the die side forming surface portion 5*b* by an amount that has been set so that in relative movement of the die 5 toward the punch 3, the die side contact surface portion 11*a* comes into contact with the metal sheet 101, before the ridgeline 3*a* of the punch 3 comes into contact with the metal sheet 101 and the metal sheet 101 is plastically deformed. This amount of protrusion has been set so that friction force between the die side elastic body 11 and the metal sheet 101 is equal to or larger than an absolute value of a difference in tension that acts on the portion 105 and the portion 107 on both sides sandwiching the character-line equivalent portion 103, the friction force being given by the product of: the load by which the portion 105 of the metal sheet 101 is pressed by contraction of the die side elastic body 11 compressed in the process of press forming; and the friction coefficient between the die side elastic body 11 (die side contact surface portion 11*a*) and the metal sheet 101.

The plastic deformation of the metal sheet 101 by the ridgeline 3*a* may be determined to be caused, for example, when the strain on a portion of the metal sheet 101 exceeds a strain $\varepsilon_0$ calculated by Equation (1) below, the portion being where the ridgeline 3*a* has come into contact with.

$$\varepsilon_0 = t/2R \tag{1}$$

Herein, R is the curvature radius of bending of the character-line 113 and t is the thickness of the metal sheet 101.

Furthermore, the friction force between the die side elastic body 11 and the metal sheet 101 is set to satisfy Equation (2) below.

$$|F_1 - F_2| \leq \times \mu_e \tag{2}$$

Herein, as illustrated in FIG. 2, $F_1$ and $F_2$ are tension that acts respectively on the portion 105 and the portion 107 on both sides sandwiching the character-line equivalent portion 103, P is the load (FIG. 2) by which the metal sheet 101 is pressed due to contraction of the die side elastic body 11, and $\mu_e$ is the friction coefficient between the die side elastic body 11 and the metal sheet 101.

The load P may be calculated from the amount of contraction upon compression until the die side contact surface portion 11*a* becomes flush with the die side forming surface portion 5*b*, and the amount of contraction of the die side elastic body 11 is assumed to be equal to the amount of protrusion of the die side elastic body 11 from the die side forming surface portion 5*b*.

The friction coefficient $\mu_e$ may be measured beforehand by a sliding test, for example. Or, in a case where a rubber material or urethane material is used as the die side elastic body 11 as described later, the friction coefficient $\mu_e$ generally equals 0.1 to 0.3 (lubricant) or $\mu_e \approx 0.5$ to 0.6 (dry), and any of these values may thus be used.

The difference in tension ($F_1 - F_2$ in Equation (2)) that acts on the portion 105 and the portion 107 on both sides sandwiching the character-line equivalent portion 103 in the process of press forming may be found beforehand by: an experiment in which tension that acts on the metal sheet 101 is actually measured by use of, for example, a strain gauge in the process of press forming to obtain the outer panel 111 of an automobile; or a press forming analysis for the outer panel 111 of an automobile by, for example, a finite element method (FEM).

The die side elastic body 11 preferably has hardness and a shape that enable the die side elastic body 11 to be deformed along the shape of the press-forming die (the shape of the die side forming surface portion 5*b*) at the bottom dead center, that is, to be deformed (to contract in the press forming direction) until the die side contact surface portion 11*a* becomes flush with the die side forming surface portion 5*b*. A specific material for this die side elastic body 11 may be, for example, a rubber material or urethane material having Shore hardness of 40 to 100 HS.

Press Forming Method

The press forming method for an outer panel of an automobile, according to the first embodiment is, as illustrated in FIG. 1, for press forming the metal sheet 101 into the outer panel 111 of an automobile by using the press forming apparatus 1 including the punch 3, the die 5, the blank holder 7, the punch side elastic body 9, and the die side elastic body 11, the outer panel 111 having the character-line 113 and the panel surface portion 115 and the panel surface portion 117 that are continuous on both sides of the character-line 113, and the press forming method includes an elastic body contact step and a press forming step.

The punch side elastic body 9 is provided in the groove 3*d* so that the punch side elastic body 9: protrudes toward the die 5 than the punch side forming surface portion 3*c*; and is thus able to come into contact with the metal sheet 101, along the character-line equivalent portion 103, on the portion 107, at a position away from the character-line equivalent portion 103, the portion 107 being on a side larger in tension in the process of press forming among the portion 105 and the portion 107 on both sides sandwiching the character-line equivalent portion 103 of the metal sheet 101.

As described already, the die side elastic body 11 is provided in the groove 5*d* so that the die side elastic body 11: protrudes toward the punch 3 than the die side forming surface portion 5*b*; and thus comes into contact with and press the metal sheet 101 on the portion 105, along the character-line equivalent portion 103, at a position away from the character-line equivalent portion 103, the portion 105 being on a side smaller in tension in the process of press forming among the portion 105 and the portion 107 on both sides sandwiching the character-line equivalent portion 103 of the metal sheet 101. Each of the elastic body contact step and the press forming step will be described hereinafter.

Elastic Body Contact Step

The elastic body contact step is, as illustrated in FIG. 1(*a*) to FIG. 1(*b*), a step of relatively moving the die 5 toward the punch 3 in a state where the end portion 101*a* and the end portion 101*b* of the metal sheet 101 are being sandwiched between the die 5 and the blank holder 7, and bringing each of the punch side contact surface portion 9*a* of the punch side elastic body 9 and the die side contact surface portion 11*a* of the die side elastic body 11 into contact with the metal sheet 101.

The punch side elastic body 9 protrudes from the punch side forming surface portion 3*c* by an amount that has been set so that: the punch side contact surface portion 9*a* comes into contact with the metal sheet 101 before the ridgeline 3*a* of the punch 3 contacts the metal sheet 101; and the punch side contact surface portion 9*a* becomes flush with the punch side forming surface portion 3*c* at the bottom dead center.

The die side elastic body 11 protrudes from the die side forming surface portion 5*b* by an amount that has been set so that: the die side contact surface portion 11*a* comes into contact with the metal sheet 101 before a portion of the metal sheet 101 is plastically deformed, the portion being where the ridgeline 3*a* of the punch 3 comes into contact with; and the die side contact surface portion 11*a* becomes flush with the die side forming surface portion 5*b* at the bottom dead center. The plastic deformation of the metal sheet 101 by the ridgeline 3*a* may be determined by, for example, the strain so found by use of Equation (1) mentioned already.

Furthermore, the amount of protrusion of the die side elastic body 11 is set, as expressed by Equation (2) mentioned already, so that the friction force becomes equal to or larger than the absolute value $|F_1-F_2|$ of the difference between the tension $F_1$ and the tension $F_2$ acting respectively toward the end portion 101*a* and the end portion 101*b* sandwiching the character-line equivalent portion 103 of the metal sheet 101, the friction force being given by the product of: the load P due to contraction (deformation) of the die side elastic body 11 in the press forming direction, the die side elastic body 11 having been compressed at the press forming step after the elastic body contact step; and the friction coefficient $\mu_e$ between the die side elastic body 11 and the metal sheet 101. Herein, the load P, the friction coefficient $\mu_e$, and the absolute value $|F_1-F_2|$ of the difference in tension preferably satisfy Equation (2) mentioned already.

Press Forming Step

The press forming step is, as illustrated in FIG. 1(*b*) to FIG. 1(*e*), a step of relatively moving the die 5 toward the punch 3 up to the bottom dead center, with the punch side contact surface portion 9*a* and the die side contact surface portion 11*a* maintained in contact with the metal sheet 101, and obtaining the outer panel 111 of an automobile by press forming, the outer panel 111 having the character-line 113 formed therein, by means of the ridgeline 3*a* and the valley-line 5*a*.

Why Skid Lines are Prevented

The following description based on FIG. 1 and FIG. 2 is on why the press forming method and press forming apparatus for outer panels of automobiles, according to the first embodiment enable obtainment of the outer panel 111 of an automobile, with skid lines being prevented.

First, the die 5 relatively moves toward the punch 3, the punch side contact surface portion 9*a* of the punch side elastic body 9 comes into contact with a surface of the portion 107 of the metal sheet 101, the surface being toward the punch 3, before the ridgeline 3*a* of the punch 3 does, and the die side contact surface portion 11*a* of the die side elastic body 11 also comes into contact with a surface of the portion 105, the surface being toward the die 5 (FIG. 1(*a*) to FIG. 1(*b*)).

Subsequently, in response to further relative movement of the die 5 toward the punch 3, the punch side elastic body 9 supports the portion 107 by being deformed while being in contact with the portion 107, and a portion extending from the character-line equivalent portion 103 to the portion 107 of the metal sheet 101 thereby gradually undergoes bending deformation to be formed into a gently curved shape (FIG. 1(*c*)). Therefore, even if the ridgeline 3*a* happens to come into contact with a portion of the metal sheet 101, generation of an initial bending defective resulting from plastic deformation of that portion is able to be prevented.

Thereafter, in the process of further relative movement of the die 5 toward the punch 3, the die side elastic body 11 comes into contact with the portion 105 and is deformed, and presses the portion 105 against the punch side forming surface portion 3*b* (FIG. 1(*d*)).

In this process, in response to contact of the ridgeline 3*a* of the punch 3 with the metal sheet 101, the tension $F_1$ and tension $F_2$ are respectively generated in directions toward the end portion 101*a* and the end portion 101*b*, with the character-line equivalent portion 103 of the metal sheet 101 being the boundary between the tension $F_1$ and the tension $F_2$ (FIG. 2). Because there is a difference between the tension $F_1$ at the end portion 101*a* and the tension $F_2$ at the end portion 101*b*, skidding from the end portion 101*a* smaller in tension toward the end portion 101*b* larger in tension may occur in the metal sheet 101 (see FIG. 9).

However, the friction between the die side elastic body 11 and the metal sheet 101 is able to prevent this skidding of the metal sheet 101 toward the end portion 101*a* larger in tension and to prevent misalignment of the character-line equivalent portion 103 plastically deformed by the ridgeline 3*a* (FIG. 1(*d*)), the die side elastic body 11 having come into contact with the portion 105 smaller in tension and having been compressed.

As described above, the die 5 is able to be relatively moved to the bottom dead center, with: the bending deformation being mitigated by the punch side elastic body 9, the bending deformation being from the character-line equivalent portion 103 to the portion 107; and the skidding of the metal sheet 101 being prevented by the die side elastic body 11, the skidding being toward the end portion 101*b* larger in tension (FIG. 1(*d*) to FIG. 1(*e*)).

At the bottom dead center, the character-line 113 is formed by the ridgeline 3*a* of the punch 3 and the valley-line 5*a* of the die 5, the panel surface portion 117 is formed by deformation of the punch side contact surface portion 9*a* of the punch side elastic body 9, the deformation being deformation in which the punch side contact surface portion 9*a* becomes flush with the punch side forming surface portion 3*c*, and the panel surface portion 115 is formed by deformation of the die side contact surface portion 11*a* of the die side elastic body 11, the deformation being deformation in which the die side contact surface portion 11*a* becomes flush with the die side forming surface portion 5*b* (FIG. 1(*e*)).

As a result, the outer panel 111 of an automobile is able to be obtained by press forming, the outer panel 111 having the character-line 113 formed therein, with skid lines being prevented.

Other Mode

In the above described press forming method and press forming apparatus for outer panels of automobiles, according to the first embodiment of the present invention, as illustrated in FIG. 1, the punch side elastic body 9 is supported by the bottom of the groove 3*d* and the die side elastic body 11 is supported by the bottom of the groove 5*d*.

Figure 3:
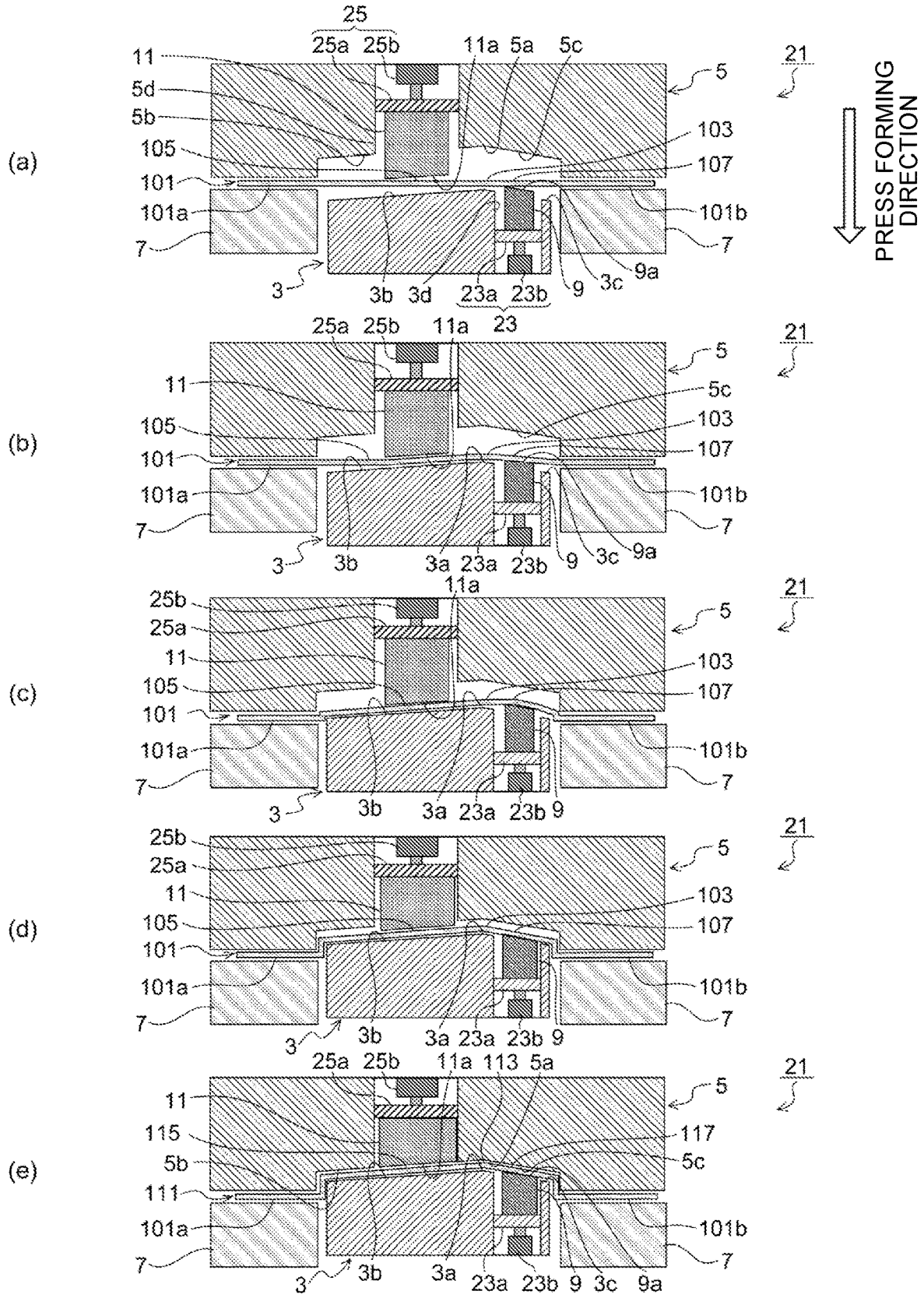
FIG. 3 is a diagram illustrating a press forming method and a configuration of a press forming apparatus, for outer panels of automobiles, according to another mode of the first embodiment of the present invention.

However, in one other mode of the first embodiment, like a press forming apparatus 21 illustrated as an example in FIG. 3, a punch side elastic body 9 may be provided in a groove 3*d* via a punch side movable body 23, and a die side elastic body 11 may be provided in a groove 5*d* via a die side movable body 25.

FIG. 3(*a*) is a state before forming is started, FIG. 3(*b*) is a state where the punch side elastic body 9 and the die side elastic body 11 are in contact with a metal sheet 101, FIG. 3(*c*) is a state where the metal sheet 101 is being supported by the punch side elastic body 9, FIG. 1(*d*) is a state where the metal sheet 101 is being pressed by the die side elastic body 11, and FIG. 1(*e*) is a state at a bottom dead center. In FIG. 3, for parts of the press forming apparatus 21, the same reference signs as those assigned in FIG. 1 will be assigned to any portions that are the same as or any portions that correspond to those of the press forming apparatus 1 illustrated in FIG. 1.

As illustrated in FIG. 3, the punch side movable body 23 pressures the punch side elastic body 9 toward a die 5 and supports the punch side elastic body 9, and includes: a pad 23*a* to which the punch side elastic body 9 is attached, the pad 23*a* being movable along a press forming direction; and a pressure source 23*b* that causes pressure to be applied to the pad 23*a*. The pressure source 23*b* may be, for example, air pressure, oil pressure, or urethane.

The pressure applied by the pressure source 23*b* of the punch side movable body 23 to the punch side elastic body 9 toward the die 5 is set so that: the punch side elastic body 9 compressed in the process of press forming illustrated in FIG. 3(*b*) to FIG. 3(*e*) is pushed back toward the bottom of the groove 3*d*; and a punch side contact surface portion 9*a* of the punch side elastic body 9 that has been compressed and deformed (has contracted) becomes flush with the punch side forming surface portion 3*c*, at the bottom dead center, as illustrated in FIG. 3(*e*).

The amount of protrusion of the punch side elastic body 9 supported by the punch side movable body 23, from the punch side forming surface portion 3*c* is set, similarly to the first embodiment described already.

As illustrated in FIG. 3, the die side movable body 25 pressures the die side elastic body 11 toward a punch 3 and supports the die side elastic body 11, and includes: a pad 25*a* to which the die side elastic body 11 is attached, the pad 25*a* being movable along the press forming direction; and a pressure source 25*b* that causes pressure to be applied to the pad 25*a*. The pressure source 25*b* may be, for example, air pressure, oil pressure, or urethane.

The pressure applied by the pressure source 25*b* of the die side movable body 25 to the die side elastic body 11 toward the punch 3 is set so that: the die side elastic body 11 compressed in the process of press forming illustrated in FIG. 3(*b*) to FIG. 3(*e*) is pushed back toward the bottom of the groove 5*d*; and a die side contact surface portion 11*a* of the die side elastic body 11 that has been compressed and deformed (has contracted) becomes flush with a die side forming surface portion 5*b*, at the bottom dead center, as illustrated in FIG. 3(*e*).

The amount of protrusion of the die side elastic body 11 supported by the die side movable body 25, from the die side forming surface portion 5*b* is set so that, as expressed by Equation (2) mentioned already, the friction force (the product of the load P and the friction coefficient $\mu_e$) between the die side elastic body 11 and the metal sheet 101 becomes equal to or larger than the absolute value ($|F_1-F_2|$) of the difference in tension acting on both sides sandwiching the character-line equivalent portion 103. This load P is the load due to the contraction of the die side elastic body 11 that has been compressed.

The following description is on functions and effects of the press forming method and press forming apparatus for outer panels of automobiles, according to this other mode of the first embodiment.

In this other mode of the first embodiment, the punch side elastic body 9 is supported by being pressured by the pressure source 23*b* of the punch side movable body 23 toward the die 5, as illustrated in FIG. 3. Therefore, as illustrated in FIG. 3(*b*) to FIG. 3(*d*), even if the punch side elastic body 9 is deformed (contracts) by relative movement of the die 5 toward the punch 3, the punch side elastic body 9 is able to be brought into contact with the metal sheet 101 and be supported, with the punch side elastic body 9 still being pressured toward the die 5.

As compared to the first embodiment (see FIG. 1) described already: adjustment of the pressure by the pressure source 23*b* that supports the punch side elastic body 9, in addition to change of the material for and/or the shape and size of the punch side elastic body 9 causes bending deformation of a portion to result in a gently curved shape, the portion being of the metal sheet 101 and being where the ridgeline 3*a* and the punch side contact surface portion 9*a* of the punch side elastic body 9 come into contact with; and press forming is thus enabled with a greater degree of freedom for preventing generation of an initial bending defective due to the ridgeline 3*a*.

Furthermore, as illustrated in FIG. 3, the die side elastic body 11 in this other mode of the first embodiment is supported by being pressured by the pressure source 25*b* of the die side movable body 25 toward the punch 3. Therefore, even in, for example, a case where sufficient friction force is unable to be obtained between the die side elastic body 11 and the metal sheet 101 or a case where the tension difference ($F_1-F_2$) in the metal sheet 101 becomes large before the load to press the metal sheet 101 by the contraction of the die side elastic body 11 becomes large enough, there is a greater degree of freedom of adjustment of the load by the die side elastic body 11 to press the metal sheet 101, the adjustment being for prevention of skidding of the metal sheet 101, through further application of a load by the pressure source 25*b* to the pad 25*a* to which the die side elastic body 11 has been attached.

As described above, the press forming method and press forming apparatus for outer panels of automobiles, according to the other mode of the first embodiment also enable press forming to obtain the outer panel 111 of an automobile, the outer panel 111 having the character-line 113 formed therein, with skid lines being effectively prevented.

As to the position at which the metal sheet 101 is pressed by the die side elastic body 11 in each of the first embodiment and the other mode of the first embodiment, as described already (see FIG. 1 and FIG. 3), the die side elastic body 11 is to come into contact with and press the metal sheet 1 on the portion 105, along the character-line equivalent portion 103, at the position away from the character-line equivalent portion 103.

The groove 5*d* is at a position away from the character-line equivalent portion 103 and is in the die side forming surface portion 5*b* that forms the panel surface portion 115 that is comparatively flat and not high in stress. Therefore, there is no problem of generating a linear defect by contact between a corner of the groove 5*d* and a portion near the character-line equivalent portion 103, this problem being generated in a case where the groove 5*d* is provided near the character-line equivalent portion 103 like in the technique described in Patent Literature 7.

A corner of the groove 5*d* to accommodate the die side elastic body 11 is preferably separate from the valley-line 5*a* by a distance that is 10% or more of the width of the die side forming surface portion 5*b*, the corner being near the character-line equivalent portion 103.

Similarly, in the first embodiment and the other mode of the first embodiment, the position at which the punch side elastic body 9 presses the metal sheet 101 is set so that the punch side elastic body 9 is caused to come into contact with the metal sheet 101 on the portion 107, along the character-line equivalent portion 103, at a position away from the character-line equivalent portion 103 (FIG. 1 and FIG. 3), as described already.

As to this point, if the punch side elastic body 9 is provided at a position near the character-line equivalent portion 103 like in the technique described in Patent Literature 7, that position is high in stress and is where the character-line 113 is formed, and the corner of the groove 3*d* will thus tend to come into contact with a portion near the character-line equivalent portion 103 and generate a linear defect.

In contrast, in each of the first embodiment and the other mode of the first embodiment, as illustrated in FIG. 1 and FIG. 3, the groove 3*d* is at a position away from the character-line equivalent portion 103 and is in the punch side forming surface portion 3*b* that forms the panel surface portion 117 comparatively flat and not high in stress. Therefore, there is no problem of generating the linear defective, the problem being caused in a case where the groove 3*d* is provided near the character-line equivalent portion 103 like in the technique described in Patent Literature 7.

A corner of the groove 3*d* to accommodate the punch side elastic body 9 is preferably separate from the ridgeline 3*a* by a distance that is 10% or more of the width of the punch side forming surface portion 3*c*, the corner being near the character-line equivalent portion 103.

Furthermore, in press forming the metal sheet 101 into the outer panel 111 of an automobile as illustrated in FIG. 1 and FIG. 3 according to the first embodiment and the other mode of the first embodiment, the order in which the punch side elastic body 9 and the die side elastic body 11 are brought into contact with the metal sheet 101 is not particularly limited.

Specifically, as long as the amount of protrusion of the punch side elastic body 9 is set so that the punch side elastic body 9 comes into contact with the metal sheet 101 before the ridgeline 3*a* of the punch 3 contacts the metal sheet 101 and the amount of protrusion of the die side elastic body 11 is set so that the die side elastic body 11 comes into contact with the metal sheet 101 before the ridgeline 3*a* of the punch 3 contacts the metal sheet 101 and plastic deformation occurs: the punch side elastic body 9 may come into contact with the metal sheet 101 first; the die side elastic body 11 may come into contact with the metal sheet 101 first; or the punch side elastic body 9 and the die side elastic body 11 may come into contact with the metal sheet 101 at the same time.

Second Embodiment

In the above described first embodiment of the present invention, as illustrated in FIG. 1, in the process of press forming the metal sheet 101 into the outer panel 111 of an automobile, the punch side elastic body 9 is brought into contact with the portion 107 larger in tension, to support the portion 107, the portion 107 being on one side of a character-line equivalent portion 103, and the die side elastic body 11 is brought into contact with the portion 105 smaller in tension to press the portion 105, the portion 105 being on the other side of the character-line equivalent portion 103.

Figure 4:
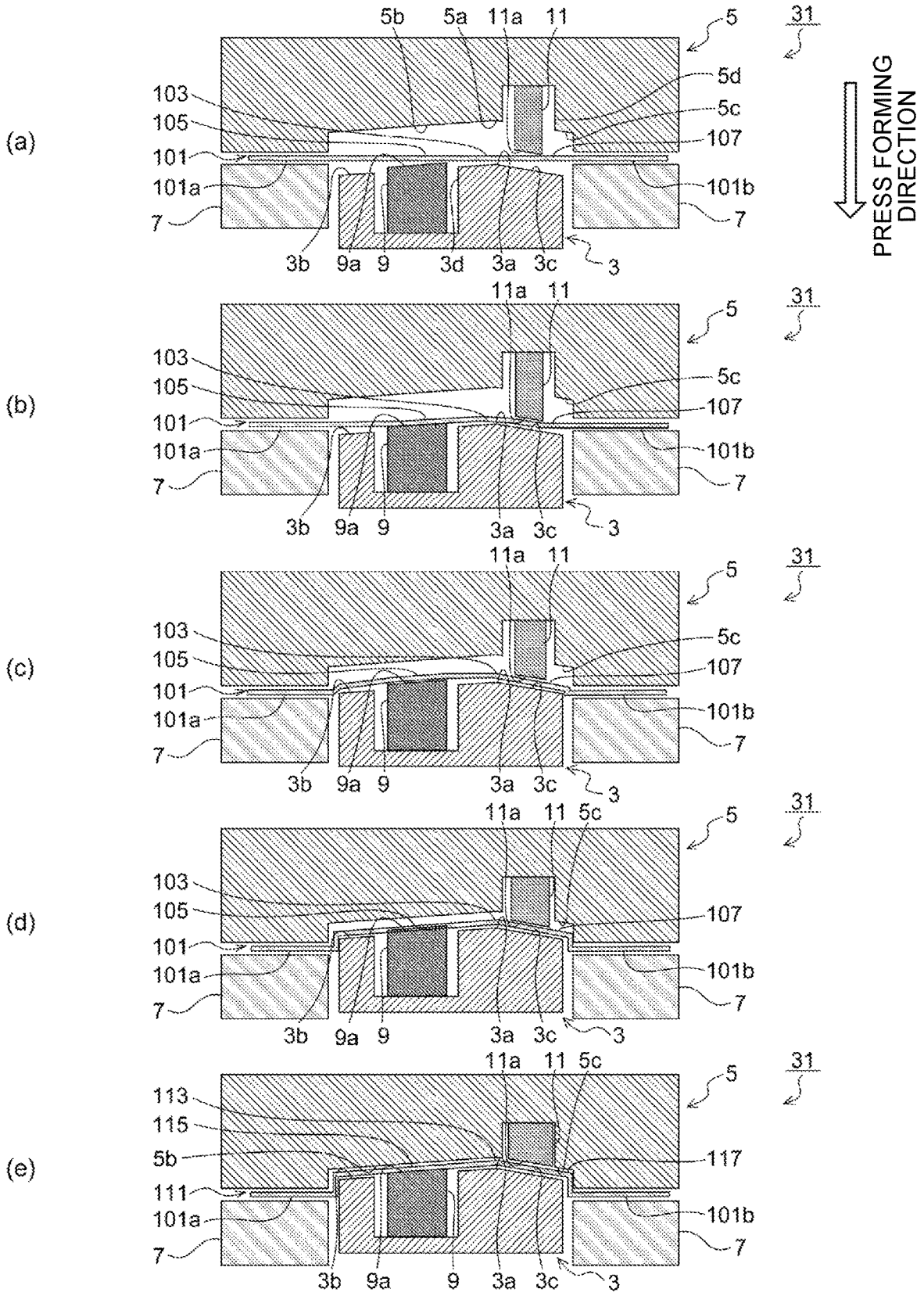
FIG. 4 is a diagram illustrating a press forming method and a configuration of a press forming apparatus, for outer panels of automobiles, according to a second embodiment of the present invention.

By contrast, in the press forming apparatus and press forming method for outer panels of automobiles, according to the second embodiment of the present invention, like in a press forming apparatus 31 illustrated as an example in FIG. 4, in the process of press forming a metal sheet 101 into an outer panel 111 of an automobile, a punch side elastic body 9 is brought into contact with a portion 105 of the metal sheet 101, to support the portion 105, the portion 105 being smaller in tension, and a die side elastic body 11 is brought into contact with a portion 107 of the metal sheet 101, to press the portion 107, the portion 107 being larger in tension.

FIG. 4(*a*) is a state before forming is started, FIG. 4(*b*) is a state where the punch side elastic body 9 and the die side elastic body 11 are in contact with the metal sheet 101, FIG. 4(*c*) is a state where the metal sheet 101 is being supported by the punch side elastic body 9, FIG. 4(*d*) is a state where the metal sheet 101 is being pressed by the die side elastic body 11, and FIG. 4(*e*) is a state at a bottom dead center. In FIG. 4, for parts of the press forming apparatus 31, the same reference signs as those assigned in FIG. 1 will be assigned to any portions that are the same as and any portions that correspond to those of the press forming apparatus 1 illustrated in FIG. 1.

As illustrated in FIG. 4, the punch side elastic body 9 is provided in the groove 3*d* so that the punch side elastic body 9 protrudes toward a die 5 than a punch side forming surface portion 3*b* and is thus able to come into contact with the metal sheet 101 on the portion 105, along the character-line equivalent portion 103, at a position away from the character-line equivalent portion 103.

As illustrated in FIG. 4, the die side elastic body 11 is provided in the groove 5*d* so that the die side elastic body 11 protrudes toward the punch 3 than a die side forming surface portion 5*c* and thus comes into contact with and press the metal sheet 101 on the portion 107, along the character-line equivalent portion 103, at a position away from the character-line equivalent portion 103.

The amount of protrusion of the punch side elastic body 9 from the punch side forming surface portion 3*b* and the amount of protrusion of the die side elastic body 11 from the die side forming surface portion 5*c* are respectively set, similarly to those in the first embodiment described already.

As illustrated in FIG. 4, the press forming method for outer panels of automobiles, according to the second embodiment is, similarly to the first embodiment illustrated in FIG. 1, for press forming the metal sheet 101 into the outer panel 111 of an automobile, the outer panel 111 having a character-line 113 and a panel surface portion 115 and a panel surface portion 117 continuous on both sides of the character-line 113, by using the press forming apparatus 31 including the punch 3, the die 5, a blank holder 7, the punch side elastic body 9, and the die side elastic body 11, and the press forming method includes an elastic body contact step and a press forming step.

The elastic body contact step is, as illustrated in FIG. 4(*a*) to FIG. 4(*b*), a step of relatively moving the die 5 toward the punch 3 in a state where an end portion 101*a* and an end portion 101*b* at both ends of the metal sheet 101 are being sandwiched between the die 5 and the blank holder 7, and bringing each of a punch side contact surface portion 9*a* of the punch side elastic body 9 and a die side contact surface portion 11*a* of the die side elastic body 11 into contact with the metal sheet 101.

The press forming step is, as illustrated in FIG. 4(*b*) to FIG. 4(*e*), a step of relatively moving the die 5 toward the punch 3 up to the bottom dead center, with the punch side contact surface portion 9*a* and the die side contact surface portion 11*a* being maintained in contact with the metal sheet 101, and press forming the metal sheet 101 into the outer panel 111 of an automobile, the outer panel 111 having the character-line 113 formed therein, by means of the ridgeline 3*a* and the valley-line 5*a*.

Why Skid Lines are Prevented

The following description mainly based on FIG. 4 is on why the press forming method and press forming apparatus for outer panels of automobiles, according to the second embodiment, enable obtainment of the outer panel 111 of an automobile by press forming, with skid lines being prevented.

First, the die 5 is relatively moved toward the punch 3, the punch side elastic body 9 provided in the punch side forming surface portion 3*b* comes into contact with the metal sheet 101 on the punch 3 side of the portion 105 before the ridgeline 3*a* of the punch 3 does, and the die side elastic body 11 provided in the die side forming surface portion 5*c* comes into contact with the metal sheet 101 on the die 5 side of the portion 107 (FIG. 4(*a*) to FIG. (*b*)).

Subsequently, relatively moving the die 5 toward the punch 3, with the punch side contact surface portion 9*a* being in contact with and supporting the portion 105 at the surface toward the punch 3 and the die side contact surface portion 11*a* being in contact with and pressing the portion 107, cause the ridgeline 3*a* of the punch 3 to come into contact with the character-line equivalent portion 103 of the metal sheet 101 (FIG. 4(*c*)).

Subsequently, relatively moving the die 5 toward the punch 3 further causes the punch side elastic body 9 to be deformed as press forming progresses. Therefore, bending deformation occurs gradually to form a gently curved shape in a range from the character-line equivalent portion 103 where the ridgeline 3*a* comes into contact with to the portion 105 where the punch side elastic body 9 comes into contact with.

Generation of an initial bending defective is thereby prevented, the initial bending defective resulting from plastic deformation caused in a case where the ridgeline 3*a* comes into contact with the metal sheet 101 before the die side elastic body 11 presses the portion 107.

Furthermore, in the process of further relative movement of the die 5 toward the punch 3, friction enables: prevention of skidding of the metal sheet 101 toward the end portion 101*b* larger in tension; and prevention of misalignment of the character-line equivalent portion 103 plastically deformed by the ridgeline 3*a* (FIG. 4(*c*) to FIG. 4(*d*)), the friction being between the metal sheet 101 and the die side elastic body 11 that has come into contact with the portion 107 larger in tension and has been compressed.

As described above, the die 5 is able to be relatively moved to the bottom dead center, with: bending deformation being mitigated by the punch side elastic body 9 over a range from the character-line equivalent portion 103 to the portion 105; and the die side elastic body 11 preventing skidding of the metal sheet 101 toward the end portion 101*b* larger in tension (FIG. 4(*d*) to FIG. 4(*e*)).

At the bottom dead center, the character-line 113 is formed by the ridgeline 3*a* of the punch 3 and the valley-line 5*a* of the die 5, the panel surface portion 115 is formed by deformation of the punch side contact surface portion 9*a* of the punch side elastic body 9, the deformation being deformation in which the punch side contact surface portion 9*a* becomes flush with the punch side forming surface portion 3*b*, and the panel surface portion 117 is formed by deformation of the die side contact surface portion 11*a* of the die side elastic body 11, the deformation being deformation in which the die side contact surface portion 11*a* becomes flush with the die side forming surface portion 5*c*.

As a result, the outer panel 111 of an automobile is able to be obtained by press forming, the outer panel 111 having the character-line 113 formed therein, with skid lines being prevented.

Other Mode

In the above described press forming method and press forming apparatus for outer panels of automobiles, according to the second embodiment of the present invention, as illustrated in FIG. 4, the punch side elastic body 9 is supported by the bottom of the groove 3*d* formed in the punch side forming surface portion 3*b*, and the die side elastic body 11 is supported by the bottom of the groove 5*d* formed in the die side forming surface portion 5*c*.

Figure 5:
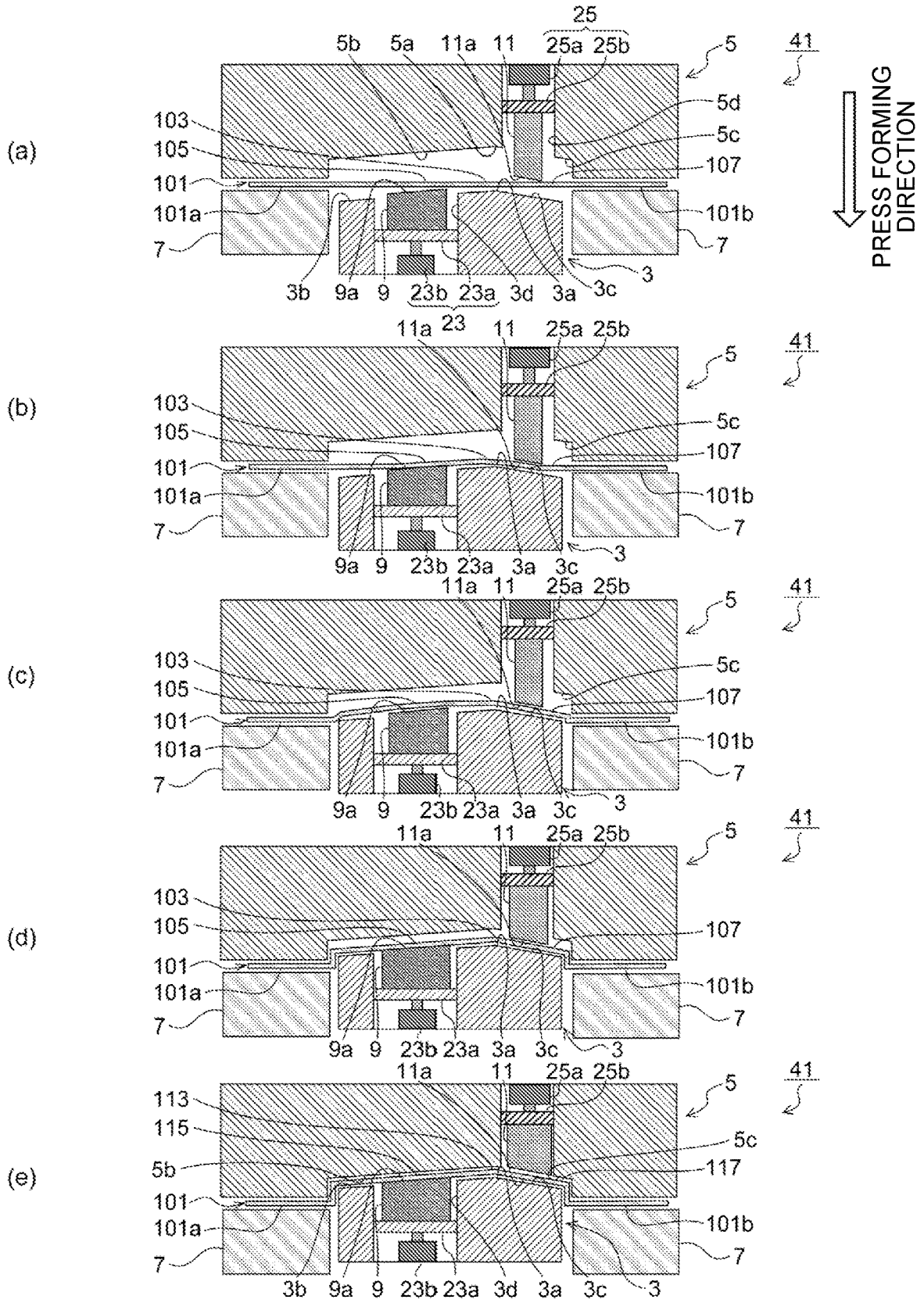
FIG. 5 is a diagram illustrating a press forming method and a configuration of a press forming apparatus, for outer panels of automobiles, according to another mode of the second embodiment of the present invention.

However, in one other mode of the second embodiment, like a press forming apparatus 41 illustrated as an example in FIG. 5, a punch side elastic body 9 may be supported by the bottom of a groove 3*d* via a punch side movable body 23, and a die side elastic body 11 may be supported by the bottom of a groove 5*d* via a die side movable body 25.

FIG. 5(*a*) is a state before forming is started, FIG. 5(*b*) is a state where the punch side elastic body 9 and the die side elastic body 11 are in contact with a metal sheet 101, FIG. 5(*c*) is a state where the metal sheet 101 is being supported by the punch side elastic body 9, FIG. 5(*d*) is a state where the metal sheet 101 is being pressed by the die side elastic body 11, and FIG. 5(*e*) is a state at a bottom dead center. In FIG. 5, for parts of the press forming apparatus 41, the same reference signs as those assigned in FIG. 1 will be assigned to any portions that are the same as and any portions that correspond to those of the press forming apparatus 1 illustrated in FIG. 1.

In this other mode of the second embodiment, the amount of protrusion of the punch side elastic body 9 from a punch side forming surface portion 3*b* and the amount of protrusion of the die side elastic body 11 from a die side forming surface portion 5*c* are respectively set similarly to those of the other mode of the first embodiment described already.

Accordingly, because the punch side elastic body 9 is supported by the punch side movable body 23, in the process of press forming illustrated in FIG. 5(*b*) to FIG. 5(*d*), similarly to the above described other mode of the first embodiment, press forming is enabled, with a greater degree of freedom for prevention of generation of an initial bending defective through bending deformation resulting in a gently curved shape, the bending deformation being of a portion of the metal sheet 101, the portion being where a ridgeline 3*a* and a punch side contact surface portion 9*a* of the punch side elastic body 9 come into contact with.

Furthermore, because the die side elastic body 11 is supported by the die side movable body 25, in the process of press forming illustrated in FIG. 5(*b*) to FIG. 5(*e*), similarly to the above described other mode of the first embodiment, there is a greater degree of freedom of adjustment of the load by the die side elastic body 11 that presses the portion 107 to prevent skidding of the metal sheet 101.

As described above, the press forming method and press forming apparatus for outer panels of automobiles, according to the other mode of the second embodiment also enable press forming to obtain the outer panel 111 of an automobile, the outer panel 111 having the character-line 113 formed therein, with skid lines being more effectively prevented.

A corner of the groove 3*d* (FIG. 4 and FIG. 5) to accommodate the punch side elastic body 9 is preferably separate from the ridgeline 3*a* by a distance that is 10% or more of the width of the punch side forming surface portion 3*b*, the corner being near the character-line 113. A corner of the groove 5*d* (FIG. 4 and FIG. 5) to accommodate the die side elastic body 11 is preferably separate from a valley-line 5*a* by a distance that is 10% or more of the width of the die side forming surface portion 5*c*, the corner being near the character-line 113. Accordingly, the problem of generation of a linear defect by contact between the corner of the groove 3*d* or corner of the groove 5*d* and a portion near the character-line equivalent portion 103 is not caused, the problem being caused in, for example, the technique described in Patent Literature 7 mentioned already.

Furthermore, in the process of press forming the metal sheet 101 into the outer panel 111 of an automobile by means of the press forming methods and press forming apparatuses for outer panels of automobiles, according to the second embodiment and the other mode of the second embodiment, similarly to the first embodiment and the other mode of the first embodiment described already, the order in which the punch side elastic body 9 and the die side elastic body 11 are brought into contact with the metal sheet 101 is not particularly limited.

A groove to accommodate a punch side elastic body, according to the present invention, needs to have a width larger than that of the punch side elastic body, to accommodate deformation of the punch side elastic body in the process of press forming. Similarly, a groove to accommodate a die side elastic body needs to have a width larger than that of the die side elastic body, to accommodate deformation of the die side elastic body in the process of press forming.

EXAMPLES

The description hereinafter is on Examples implemented for validating the effect of preventing skid lines upon formation of a character-line in obtaining an outer panel of an automobile by press forming by use of a press forming method and a press forming apparatus for outer panels of automobiles, according to the present invention.

In Examples, whether or not a skid line was generated on an outer panel obtained by press forming was checked by a press forming analysis in which the outer panel was obtained by press forming through a press forming method according to the present invention, the outer panel simulating an outer panel of an automobile, the outer panel having a character-line.

Figure 6:
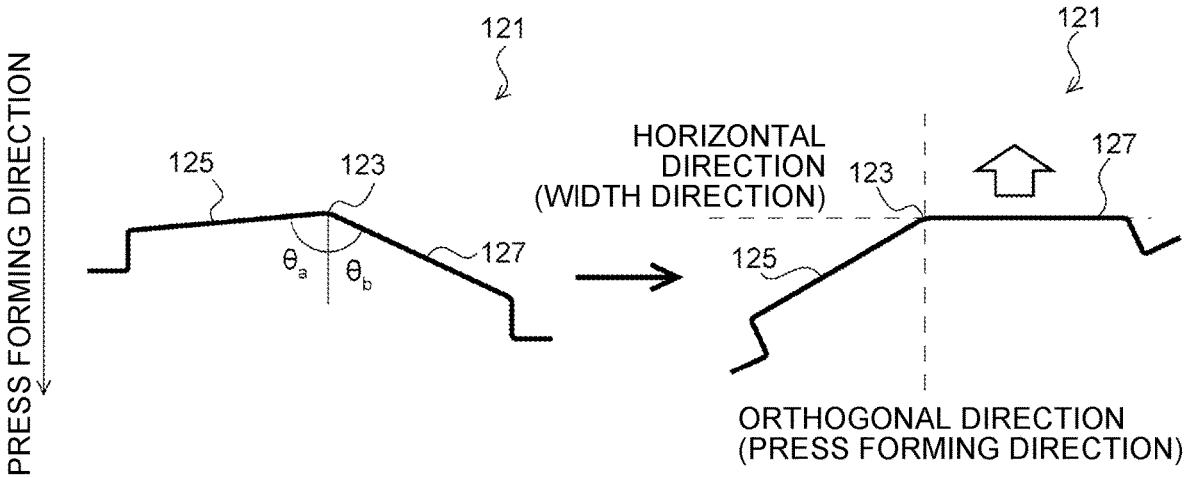
FIG. 6 is a diagram illustrating an outer panel to be formed in Examples, and arrangement upon evaluation of the shape of and any skid line in a panel surface portion of the outer panel.

In the press forming analysis, a steel sheet SGCC-F having a thickness of 0.7 mm was used as a metal sheet, and the target to be analyzed was an outer panel 121 illustrated in FIG. 6 and having a character-line 123 and a panel surface portion 125 and a panel surface portion 127 that are on both sides of the character-line 123 and are continuous.

The character-line 123 had a curvature radius of 3 mm, angles of the panel surface portion 125 and the panel surface portion 127 to a press forming direction were respectively $\theta_a$=850 and $\theta_b$=65°, widths of the panel surface portion 125 and the panel surface portion 127 (lengths from the boundary on the character-line to their ends) were both 50 mm.

In Conventional Example of Examples, a press forming analysis of a process of deep drawing a metal sheet into an outer panel (see FIG. 9) by means of a press forming apparatus including a punch, a die, and a blank holder was performed.

A difference in tension generated in the process of press forming, between the panel surface portion 127 smaller in angle ($\theta_b$=65°) and the panel surface portion 125 larger in angle ($\theta_a$=85°) was found to be 202 kN.

Next, in Example of the invention, a press forming analysis of press forming a metal sheet 101 into an outer panel 121 (FIG. 6) by use of a press forming apparatus 1 including a punch 3, a die 5, a blank holder 7, a punch side elastic body 9, and a die side elastic body 11, like the one illustrated in FIG. 1, was performed.

In the press forming analysis, the punch side elastic body 9 was provided in a groove 3*d* of a punch side forming surface portion 3*c*, to protrude toward the die 5 from the punch side forming surface portion 3*c*. The punch side elastic body 9 was set to come into contact with a portion corresponding to the panel surface portion 127 at a smaller acute angle to the press forming direction, the portion being at a position away from a character-line equivalent portion 103 corresponding to the character-line 123 (the boundary of the groove 3*d* of the punch 3 is at a position that is 10% of the width of the punch side forming surface portion 3*c*, the boundary being near the character-line equivalent portion 103). The amount of protrusion of the punch side elastic body 9 from the punch side forming surface portion 3*c* was set at 5 mm so that the punch side contact surface portion 9*a* came into contact with the metal sheet 101 before a ridgeline 3*a* of the punch 3 contacted the metal sheet 101.

The die side elastic body 11 was provided in a groove 5*d* in a die side forming surface portion 5*b*, to protrude toward the punch 3 from the die side forming surface portion 5*b*. The die side elastic body 11 was then caused to come into contact with and to press a portion corresponding to the panel surface portion 125 at a larger acute angle to the press forming direction, the portion being at a position away from the character-line equivalent portion 103 (a boundary of the groove 5*d* of the die 5 is at a position that is 10% of the width of the die side forming surface portion 5*b*, the boundary being near the character-line equivalent portion 103). The amount of protrusion of the die side elastic body 11 from the die side forming surface portion 5*b* was set at 12 mm on the basis of a difference in tension (=202 kN) acting on both sides sandwiching the character-line equivalent portion 103 in the process of press forming according to Conventional Example (see FIG. 9).

In the press forming analysis, the punch side elastic body 9 and die side elastic body 11 were both made of hard urethane and the friction coefficients between the metal sheet 101 and the punch side elastic body 9 and die side elastic body 11 were both 0.6, and the punch side elastic body 9 and die side elastic body 11 both had an elastic modulus of 253 N/mm.

Figure 7:
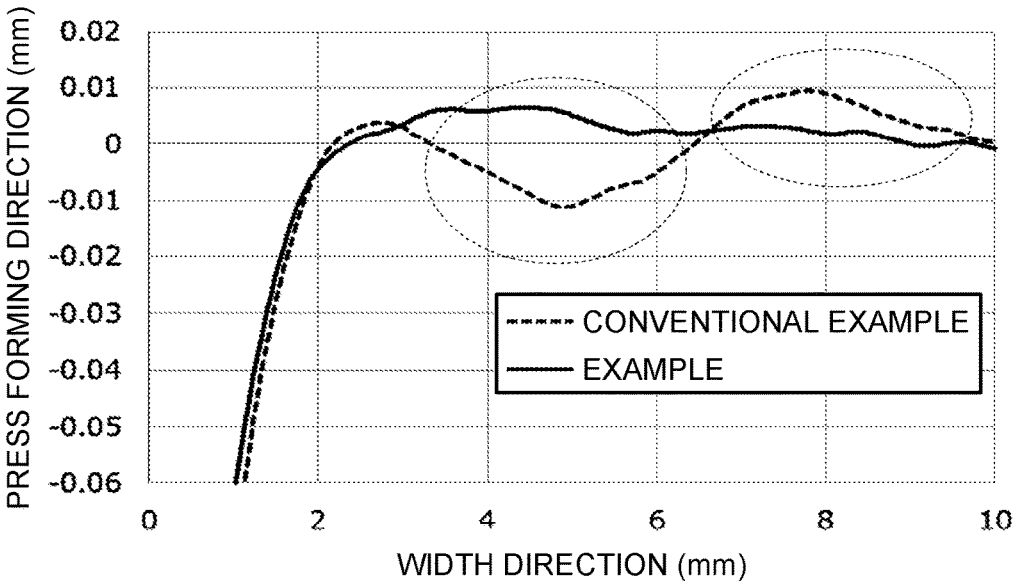
FIG. 7 is a diagram illustrating results for cross-sectional shapes of outer panels, the results having been found by press forming analyses, in Examples.

FIG. 7 illustrates results for cross-sectional shapes of the outer panels 121 obtained by the press forming analyses. FIG. 7 illustrates the enlarged cross-sectional shapes of portions of the outer panels 121, the portions being around the character-lines 123, on a coordinate plane having a horizontal axis representing a horizontal direction (=the width direction of the panel surface portion 127) parallel to the panel surface portion 127 and a vertical axis representing a direction (=the press forming direction) orthogonal to the panel surface portion 127, the results for the cross-sectional shapes of the outer panels 121 being arranged to be rotated so that the panel surface portions 127 smaller in angle to the press forming direction became horizontal as illustrated in FIG. 6.

From FIG. 7, in contrast to Example of the invention, concavity and convexity (portions surrounded with dotted ellipses in FIG. 7) caused by a skid line in the panel surface portion 127 larger in tension per unit area were observed in the Conventional Example.

Figure 8:
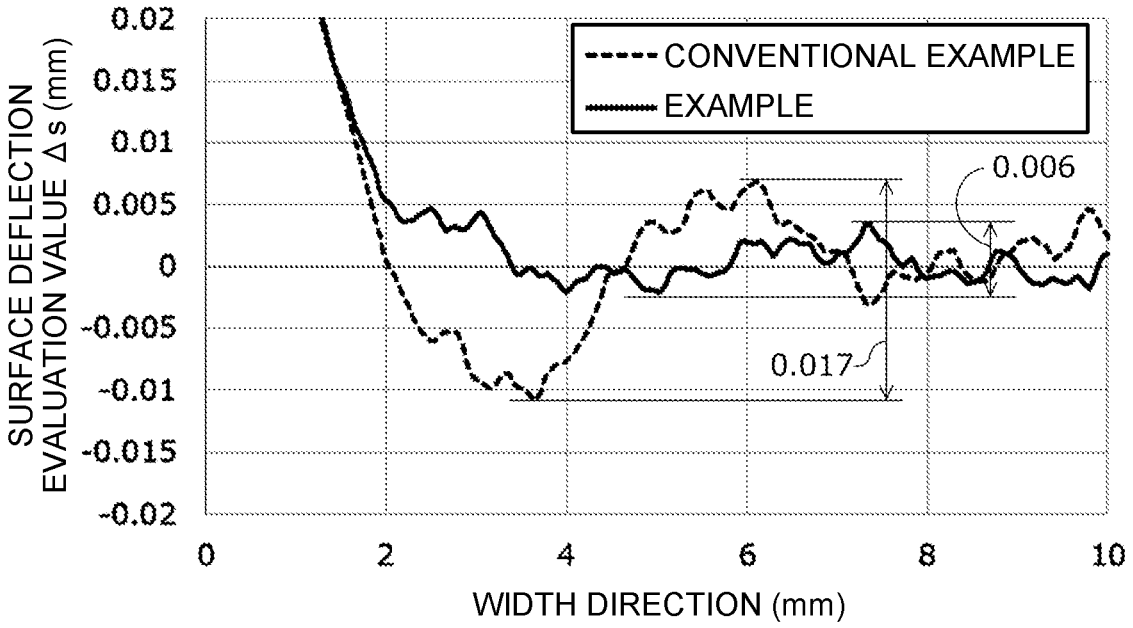
FIG. 8 is a diagram illustrating results for evaluation values Δs for surface deflection of the outer panels, the results having been found by the press forming analyses, in Examples.

FIG. 8 illustrates results of evaluation of surface deflection for the outer panels 121 obtained in the press forming analyses. FIG. 8 is a graph having a horizontal axis representing horizontal coordinates of the panel surface portions 127 when the panel surface portions 127 smaller in acute angle to the press forming direction are arranged to be horizontal, and a vertical axis representing the evaluation value Δs for surface deflection at each horizontal position.

The evaluation value Δs for surface deflection is represented by, as described in the following publicly known reference, a difference between the maximum and the minimum of the mountain height measured by a three-point gauge (fixed span L).

Reference: The Japan Sheet Metal Forming Research Group, Fourth Edition of Press Forming Difficulty Handbook, "Chapter 5 Poor Surface Shape Precision and Evaluation of Difficulty of Forming", pages 218 to 221, Nikkan Kogyo Shimbun, Ltd. (2017).

From FIG. 8, the difference between the maximum and the minimum of the evaluation value Δs of surface deflection was 0.017 in Conventional Example and 0.006 in Example of the invention. It can thereby be understood that the punch side elastic body 9 was brought into contact with the metal sheet 101 and supported the metal sheet 101 so that bending deformation resulted in a gently curved shape, the die side elastic body 11 pressed the metal sheet 101 for press forming, and surface deflection in the panel surface portion 127 was thereby reduced.

As described above, it was demonstrated that the present invention enables obtainment of an outer panel of an automobile by press forming with skid lines being prevented, the outer panel having a character-line formed therein.

FIG. 7 and FIG. 8 illustrate results for a case where the punch side elastic body 9 was provided for a portion 107 of the metal sheet 101, the portion 107 being larger in tension, and the die side elastic body 11 was provided for a portion 105 of the metal sheet 101, the portion 105 being smaller in tension, similarly to the first embodiment described already.

Press forming analyses were performed similarly for a case (FIG. 4) where the punch side elastic body 9 was provided for the portion 105 smaller in tension and the die side elastic body 11 was provided for the portion 107 larger in tension, and a case (FIG. 3 and FIG. 5) where the punch side elastic body 9 was supported by a punch side movable body 23 and the die side elastic body 11 was supported by a die side movable body 25. Results of these press forming analyses are not illustrated in the drawings, but for both cases, it was confirmed that press forming was enabled with skid lines being prevented, the press forming being for an outer panel having a character-line formed therein.

INDUSTRIAL APPLICABILITY

The present invention enables provision of a press forming method and a press forming apparatus, for outer panels of automobiles, for formation of targeted character-lines, with skid lines being prevented without increase in man-hours for press forming.

REFERENCE SIGNS LIST

1 PRESS FORMING APPARATUS
3 PUNCH
3*a* RIDGELINE
3*b* PUNCH SIDE FORMING SURFACE PORTION
3*c* PUNCH SIDE FORMING SURFACE PORTION
3*d* GROOVE
5 DIE
5*a* VALLEY-LINE
5*b* DIE SIDE FORMING SURFACE PORTION
5*c* DIE SIDE FORMING SURFACE PORTION
5*d* GROOVE
7 BLANK HOLDER
9 PUNCH SIDE ELASTIC BODY
9*a* PUNCH SIDE CONTACT SURFACE PORTION
11 DIE SIDE ELASTIC BODY
11*a* DIE SIDE CONTACT SURFACE PORTION
21 PRESS FORMING APPARATUS
23 PUNCH SIDE MOVABLE BODY
23*a* PAD
23*b* PRESSURE SOURCE
25 DIE SIDE MOVABLE BODY
25*a* PAD
25*b* PRESSURE SOURCE
31 PRESS FORMING APPARATUS
41 PRESS FORMING APPARATUS
51 PRESS FORMING APPARATUS (CONVENTIONAL ART)
53 PUNCH
53*a* RIDGELINE
55 DIE
55*a* VALLEY-LINE
57 BLANK HOLDER
101 METAL SHEET
101*a* END PORTION
101*b* END PORTION
103 CHARACTER-LINE EQUIVALENT PORTION
105 PORTION
107 PORTION
111 OUTER PANEL OF AUTOMOBILE
113 CHARACTER-LINE
115 PANEL SURFACE PORTION
117 PANEL SURFACE PORTION
121 OUTER PANEL (EXAMPLE)
123 CHARACTER-LINE
125 PANEL SURFACE PORTION
127 PANEL SURFACE PORTION

The invention claimed is:

1. A press forming method for an outer panel of an automobile, for press forming a metal sheet into the outer panel of the automobile, the outer panel having a character-line and a panel surface portion that is continuous on both sides of the character-line, the press forming method comprising:

providing a punch, a die facing the punch, and a blank holder facing end portions of the die, wherein the punch includes:

a ridgeline to form the character-line;

a punch side forming surface portion to form the panel surface portion; and a punch side elastic body supported to protrude toward the die than the punch side forming surface portion so that the punch side elastic body is able to come into contact with the metal sheet, along a character-line equivalent portion corresponding to the character-line in the metal sheet, at a position away from the character-line equivalent portion, on a side larger in tension in the press forming among portions on both sides sandwiching the character-line equivalent portion, and the die includes:

a valley-line to form the character-line in cooperation with the ridgeline;

a die side forming surface portion to form the panel surface portion; and a die-side elastic body supported to protrude toward the punch than the die side forming surface portion so that the die side elastic body comes into contact with and press the metal sheet, along the character-line equivalent portion, at a position away from the character-line equivalent portion, on a side smaller in tension in the press forming among portions on both sides sandwiching the character-line equivalent portion, setting an amount of protrusion of the punch side elastic body from the punch side forming surface portion so that the punch side elastic body:

comes into contact with the metal sheet before the ridgeline of the punch contacts the metal sheet when the die is relatively moved toward the punch; and becomes flush with the punch side forming surface portion at a bottom dead center;

setting an amount of protrusion of the die side elastic body from the die side forming surface portion so that:

the die side elastic body comes into contact with the metal sheet before the ridgeline of the punch contacts the metal sheet and the metal sheet is plastically deformed when the die is relatively moved toward the punch; and a friction force between the die side elastic body and the metal sheet becomes equal to or larger than an absolute value of a difference between tensions acting on the portions on both sides sandwiching the character-line equivalent portion when the metal sheet is press formed, where the friction force is given by a product of:

a load of the die side elastic body pressing the metal sheet at the press forming the metal sheet; and a friction coefficient between the die side elastic body and the metal sheet;

relatively moving the die toward the punch in a state where both end portions of the metal sheet are sandwiched between the die and the blank holder;

bringing each of the punch side elastic body and the die side elastic body into contact with the metal sheet; and press forming the metal sheet into the outer panel of the automobile, the outer panel having the character-line formed by means of the ridgeline and the valley-line, by relatively moving the die toward the punch up to the bottom dead center with the punch side elastic body and the die side elastic body both being in contact with the metal sheet.

2. The press forming method for the outer panel of the automobile according to claim 1, wherein the punch side elastic body is movable along a press forming direction and is provided in the punch via a punch side movable body that supports the punch side elastic body by pressuring the punch side elastic body toward the die.

3. The press forming method for the outer panel of the automobile according to claim 2, wherein the die side elastic body is movable along a press forming direction and is provided in the die via a die side movable body that supports the die side elastic body by pressuring the die side elastic body toward the punch.

4. The press forming method for the outer panel of the automobile according to claim 1, wherein the die side elastic body is movable along a press forming direction and is provided in the die via a die side movable body that supports the die side elastic body by pressuring the die side elastic body toward the punch.

5. A press forming method for an outer panel of an automobile, for press forming a metal sheet into the outer panel of the automobile, the outer panel having a character-line and a panel surface portion that is continuous on both sides of the character-line, the press forming method comprising:

providing a punch, a die facing the punch, and a blank holder facing end portions of the die, wherein the punch includes:

a ridgeline to form the character-line;

a punch side forming surface portion to form the panel surface portion; and a punch side elastic body supported to protrude toward the die than the punch side forming surface portion so that the punch side elastic body is able to come into contact with the metal sheet, along a character-line equivalent portion corresponding to the character-line in the metal sheet, at a position away from the character-line equivalent portion, on a side smaller in tension in the press forming among portions on both sides sandwiching the character-line equivalent portion, and the die includes:

a valley-line to form the character-line in cooperation with the ridgeline;

a die side forming surface portion to form the panel surface portion; and a die-side elastic body supported to protrude toward the punch than the die side forming surface portion so that the die side elastic body comes into contact with and press the metal sheet, along the character-line equivalent portion, at a position away from the character-line equivalent portion, on a side larger in tension in the press forming among portions on both sides sandwiching the character-line equivalent portion;

setting an amount of protrusion of the punch side elastic body from the punch side forming surface portion so that the punch side elastic body:

comes into contact with the metal sheet before the ridgeline of the punch contacts the metal sheet when the die is relatively moved toward the punch; and becomes flush with the punch side forming surface portion at a bottom dead center;

setting an amount of protrusion of the die side elastic body from the die side forming surface portion so that:

the die side elastic body comes into contact with the metal sheet before the ridgeline of the punch contacts the metal sheet and the metal sheet is plastically deformed when the die is relatively moved toward the punch; and a friction force between the die side elastic body and the metal sheet becomes equal to or larger than an absolute value of a difference between tensions acting on the portions on both sides sandwiching the character-line equivalent portion when the metal sheet is press formed, where the friction force is given by a product of:

a load of the die side elastic body pressing the metal sheet at the press forming the metal sheet; and a friction coefficient between the die side elastic body and the metal sheet;

relatively moving the die toward the punch in a state where both end portions of the metal sheet are being sandwiched between the die and the blank holder;

bringing each of the punch side elastic body and the die side elastic body into contact with the metal sheet; and press forming the metal sheet into the outer panel of the automobile, the outer panel having the character-line formed by means of the ridgeline and the valley-line, by relatively moving the die toward the punch up to a bottom dead center with the punch side elastic body and the die side elastic body both being in contact with the metal sheet.

6. The press forming method for the outer panel of the automobile according to claim 5, wherein the punch side elastic body is movable along a press forming direction and is provided in the punch via a punch side movable body that supports the punch side elastic body by pressuring the punch side elastic body toward the die.

7. The press forming method for the outer panel of the automobile according to claim 6, wherein the die side elastic body is movable along a press forming direction and is provided in the die via a die side movable body that supports the die side elastic body by pressuring the die side elastic body toward the punch.

8. The press forming method for the outer panel of the automobile according to claim 5, wherein the die side elastic body is movable along a press forming direction and is provided in the die via a die side movable body that supports the die side elastic body by pressuring the die side elastic body toward the punch.

9. A press forming apparatus for an outer panel of an automobile, for press forming a metal sheet into the outer panel of the automobile, the outer panel having a character-line and a panel surface portion that is continuous on both sides of the character-line, the press forming apparatus comprising:

a punch;

a die facing the punch; and a blank holder facing end portions of the die, wherein the punch includes:

a ridgeline to form the character-line;

a punch side forming surface portion to form the panel surface portion; and a punch side elastic body supported to protrude toward the die than the punch side forming surface portion so that the punch side elastic body is able to come into contact with the metal sheet, along a character-line equivalent portion corresponding to the character-line in the metal sheet, at a position away from the character-line equivalent portion, on a side larger in tension in the press forming among portions on both sides sandwiching the character-line equivalent portion, and the die includes:

a valley-line to form the character-line in cooperation with the ridgeline;

a die side forming surface portion to form the panel surface portion; and a die-side elastic body supported to protrude toward the punch than the die side forming surface portion so that the die side elastic body comes into contact with and press the metal sheet, along the character-line equivalent portion, at a position away from the character-line equivalent portion, on a side smaller in tension in the press forming among portions on both sides sandwiching the character-line equivalent portion, wherein an amount of protrusion of the punch side elastic body from the punch side forming surface portion is set so that the punch side elastic body:

comes into contact with the metal sheet before the ridgeline of the punch contacts the metal sheet when the die is relatively moved toward the punch; and becomes flush with the punch side forming surface portion at a bottom dead center, and an amount of protrusion of the die side elastic body from the die side forming surface portion is set so that:

the die side elastic body comes into contact with the metal sheet before the ridgeline of the punch contacts the metal sheet and the metal sheet is plastically deformed when the die is relatively moved toward the punch; and a friction force between the die side elastic body and the metal sheet becomes equal to or larger than an absolute value of a difference between tensions acting on the portions on both sides sandwiching the character-line equivalent portion when the metal sheet is press formed, where the friction force is given by a product of:

a load of the die side elastic body pressing the metal sheet; and a friction coefficient between the die side elastic body and the metal sheet.

10. The press forming apparatus for the outer panel of the automobile according to claim 9, wherein the punch side elastic body is movable along a press forming direction and is provided in the punch via a punch side movable body that supports the punch side elastic body by pressuring the punch side elastic body toward the die.

11. The press forming apparatus for the outer panel of the automobile according to claim 10, wherein the die side elastic body is movable along a press forming direction and is provided in the die via a die side movable body that supports the die side elastic body by pressuring the die side elastic body toward the punch.

12. The press forming apparatus for the outer panel of the automobile according to claim 9, wherein the die side elastic body is movable along a press forming direction and is provided in the die via a die side movable body that supports the die side elastic body by pressuring the die side elastic body toward the punch.

13. A press forming apparatus for an outer panel of an automobile, for press forming a metal sheet into the outer panel of the automobile, the outer panel having a character-line and panel surface portion that is continuous on both sides of the character-line, the press forming apparatus comprising:

a punch;

a die facing the punch; and a blank holder facing end portions of the die, wherein the punch includes:

a ridgeline to form the character-line;

a punch side forming surface portion to form the panel surface portion; and a punch side elastic body supported to protrude toward the die than the punch side forming surface portion so that the punch side elastic body is able to come into contact with the metal sheet, along a character-line equivalent portion corresponding to the character-line in the metal sheet, at a position away from the character-line equivalent portion, on a side smaller in tension in the press forming among portions on both sides sandwiching the character-line equivalent portion, and the die includes:

a valley-line to form the character-line in cooperation with the ridgeline;

a die side forming surface portion to form the panel surface portion; and a die-side elastic body supported to protrude toward the punch than the die side forming surface portion so that the die side elastic body comes into contact with and press the metal sheet, along the character-line equivalent portion, at a position away from the character-line equivalent portion, on a side larger in tension in the press forming among portions on both sides sandwiching the character-line equivalent portion, wherein an amount of protrusion of the punch side elastic body from the punch side forming surface portion is set so that the punch side elastic body:

comes into contact with the metal sheet before the ridgeline of the punch contacts the metal sheet when the die is relatively moved toward the punch; and becomes flush with the punch side forming surface portion at a bottom dead center, and an amount of protrusion of the die side elastic body from the die side forming surface portion is set so that:

the die side elastic body comes into contact with the metal sheet before the ridgeline of the punch contacts the metal sheet and the metal sheet is plastically deformed when the die is relatively moved toward the punch; and a friction force between the die side elastic body and the metal sheet becomes equal to or larger than an absolute value of a difference between tensions acting on the portions on both sides sandwiching the character-line equivalent portion when the metal sheet is press formed, where the friction force is given by a product of:

a load of the die side elastic body pressing the metal sheet; and a friction coefficient between the die side elastic body and the metal sheet.

14. The press forming apparatus for the outer panel of the automobile according to claim 13, wherein the punch side elastic body is movable along a press forming direction and is provided in the punch via a punch side movable body that supports the punch side elastic body by pressuring the punch side elastic body toward the die.

15. The press forming apparatus for the outer panel of the automobile according to claim 14, wherein the die side elastic body is movable along a press forming direction and is provided in the die via a die side movable body that supports the die side elastic body by pressuring the die side elastic body toward the punch.

16. The press forming apparatus for the outer panel of the automobile according to claim 13, wherein the die side elastic body is movable along a press forming direction and is provided in the die via a die side movable body that supports the die side elastic body by pressuring the die side elastic body toward the punch.

* * * * *